United States Patent [19]

Marshall et al.

[11] Patent Number: 4,901,773

[45] Date of Patent: Feb. 20, 1990

[54] HIGH VOLTAGE COIL WINDING MACHINE

[75] Inventors: James W. Marshall, Towson; Somers H. Smith, III, Cockeysville, both of Md.; Clair E. Piatt, Bronson, Mich.; Rickey W. Bryant, Lexington, Ky.; Donald S. Lee, Kingsville, Md.; Herbert J. Macemon, Versailles, Ky.; Robert B. Wood, Jr., Stewartstown, Pa.; Ricky L. Wallace, Baltimore, Md.

[73] Assignee: Kuhlman Corporation, Troy, Mich.

[21] Appl. No.: 260,579

[22] Filed: Oct. 24, 1988

[51] Int. Cl.[4] ..... B21F 3/00

[52] U.S. Cl. ..... 140/92.1; 29/605

[58] Field of Search ..... 140/1, 92.1, 92.2; 29/33 F, 33 S, 564, 564.6, 605

[56] References Cited

U.S. PATENT DOCUMENTS

| | | | |
|---|---|---|---|
| 2,712,836 | 7/1955 | Marzolf | 140/92.1 |
| 3,036,603 | 5/1962 | Moore | 140/92.1 |
| 3,063,475 | 11/1962 | Possis et al. | 140/92.1 |
| 4,046,175 | 9/1977 | Gardner et al. | 140/92.1 |
| 4,434,945 | 3/1984 | Hamane et al. | 140/92.1 |
| 4,790,063 | 12/1988 | Kawazoe et al. | 140/92.1 |

*Primary Examiner*—Lowell A. Larson

*Attorney, Agent, or Firm*—Townsend and Townsend

[57] ABSTRACT

The coil winding machine (10) winds a series of interconnected coil bundles within winding forms (28). The winding forms are transferred from a coil winding station (29), at which the coil is wound in the pie-shaped cavity of the winding form, to a coil removal station (237,293,61), at which the winding form is separated and the coil is removed and placed on a storage arbor (54) in the proper order for later assembly in a transformer, and finally, after reassembly of the winding form, back to the winding station.

111 Claims, 21 Drawing Sheets

HIGH VOLTAGE COIL WINDING MACHINE

BACKGROUND OF THE INVENTION

United States Patent to Macemon et al., entitled Apparatus And Method For Fabricating A High Voltage Winding For A Toroidal Transformer, No. 4,683,919, issued Aug. 4, 1987, and U.S. Pat. to Macemon et al., having the same title, No. 4,699,184, issued Oct. 13, 1987, the disclosures of which are incorporated by reference, disclose a high voltage winding machine for winding a plurality of pie-shaped coil bundles which are interconnected by at least one continuous wire from which the coil bundles have been wound so that the coil bundles, after removal from the winding machine, can be positioned in an arc to form at least a part of a toroidal winding. In those machines, a mandrel is provided with a series of pie-shaped coil forms so that an interconnected sequence of pie-shaped coil bundles can be wound sequentially on the mandrel. To wind the pie-shaped coil bundles, the mandrel rotates with respect to a wire guiding device so that the wire is accurately placed within a pie-shaped cavity defined by the pie-shaped forms, including the undercut portion of the forms. Because all of the pie-shaped coil bundles are located on a single mandrel and thus rotate together until the last coil bundle is wound, the prior machines make it difficult to perform post-winding operations on the already-completed coil bundles during rotation of the winding mandrel. Thus, the prior machines, although producing completely satisfactory toroidal windings, have the disadvantage that post-winding processing of the coil bundle must await the completion of the winding of the last of the coil bundles in the sequence.

SUMMARY OF THE INVENTION

The present invention provides the advantage of allowing post-winding operations to be performed on already-wound coil bundles while subsequent coil bundles in the same sequence are being wound. This is accomplished by a novel combination of a fly winder and a transfer machine which accommodates both fly winding and post-winding operations, while at all times maintaining the coil bundles in the proper sequence and maintaining a spacing between the coil bundles which does not exceed a predetermined minimum length of interconnecting wire.

While throughout the specification, the connecting wire from which the coil bundles are wound is referred to in the singular, it should be understood that the present invention contemplates and encompasses bi-filar and multi-filar windings in which more than one wire would be used to wind the coils. Therefore, the singular term "wire" should be interpreted to mean "at least one wire."

In the preferred implementation of the novel combination of a fly winder and a transfer machine of this invention, the transfer machine carries a plurality of wire winding forms, the number of which may vary depending upon the number of post-winding operations performed, the duration of the post-winding operations, the number of coil bundles in the sequence, and the convenience of positioning of machine elements. That number can be larger or less than the number of coil bundles in a sequence. The winding forms are selectively positioned by the transfer machine at a plurality of positions or operative stations, e.g., a winding station at which the fly winder winds the wire into a pie-shaped coil bundle, one or more intermediate stations at which post-winding operations are performed and an unloading station in which the pie-shaped coil bundles are removed from the transfer machine while maintaining the order and proper separation of the sequential pie-shaped coil bundles.

In the preferred embodiment, the transfer machine is a linear type and includes one or more post-winding processing stations, for example, one or more stations for bonding or securing the pie-shaped coil bundles in the pie-shape form so that the coil bundles can later be conveniently manipulated and assembled into a toroidal winding. To facilitate bonding, the insulated winding wire is coated with a thermoplastic adhesive. In the particular embodiment disclosed, there are several bonding stations which are adapted to heat the pie-shaped coil bundles to cause the thermoplastic adhesive coating on adjacent turns to bond and several cooling stations to allow the bond to set. It should be understood, however, that the post-winding operations could occur after the wound pie-shaped coil bundles are unloaded at the unloading station while still accomplishing those post-winding operations on completed coil bundles during the winding of subsequent coil bundles in the same sequence. Therefore, in its broadest form, the present invention contemplates either performing post-winding operations on completed bundles in a sequence while subsequent bundles are being wound whether those post-winding operations occur at stations which are intermediate the winding station and the unloading station or whether those post-winding operations occur subsequent to the unloading station. However, as will be apparent herein, certain additional non-obvious advantages and features flow from the preferred embodiment in which the post-winding operations occur intermediate the winding station and unloading station.

As a further feature of this invention, pie-shaped coil winding forms comprise a front side member and a back side member which converge to define the pie-shaped coil cavities. The front side member denotes the side member which is closest to and faces the winding arm during winding of the coil. The front side member and the back side member are joined by a core portion which positions the radially-inside turns of the coils. The pie-shaped coil winding forms are adapted so that the front side member can be separated from the back side member with the core portion being retained on the front side member. Thus, a coil wound onto a pie-shaped coil winding form will be retained on the core and will remain with the front side member upon separation. According to the present invention, this unique feature is used to unload the completed pie-shaped coil bundles from the "back" of the pie-shaped coil winding forms so as to maintain the sequence of pie-shaped coil bundles in their proper positional relationship and without exceeding the length of an interconnecting wire of a predetermined minimum functional length. The transfer machine also includes a mechanism for reassembling the pie-shaped coil winding form after the completed pie-shaped coil bundle has been removed and for returning the now-empty pie-shaped coil winding forms to the winding station.

In summary, the present invention provides the important advantage of allowing post-winding operations to be performed on the pie-shaped coil bundles during the time that subsequent pie-shaped coil bundles are being wound. Since a significant amount of time is required for winding so that winding tensions and other constraints are not exceeded, it is highly desirable and efficient to make use of that time for other time-consuming operations, for example, a heating and cooling operation in which the turns of each coil bundle are bound to secure the turns in the pie-shaped form. It will be appreciated that if the bonding steps did not occur until after the last of the sequence of pie-shaped coil bundles have been wound, all of the time required by that bonding step would be in addition to the time required for winding, rather than being included within it. Thus, the present invention provides significant savings in the time required to fully process a toroidal winding made up of a sequence of pie-shaped coil bundles and adds to the efficiency and economy of toroidal transformer manufacture. Other features and advantages of the present invention will be apparent in view of the following detailed description of the preferred embodiment.

DETAILED DESCRIPTION OF THE PREFERRED EMBODIMENT

Figure 1:
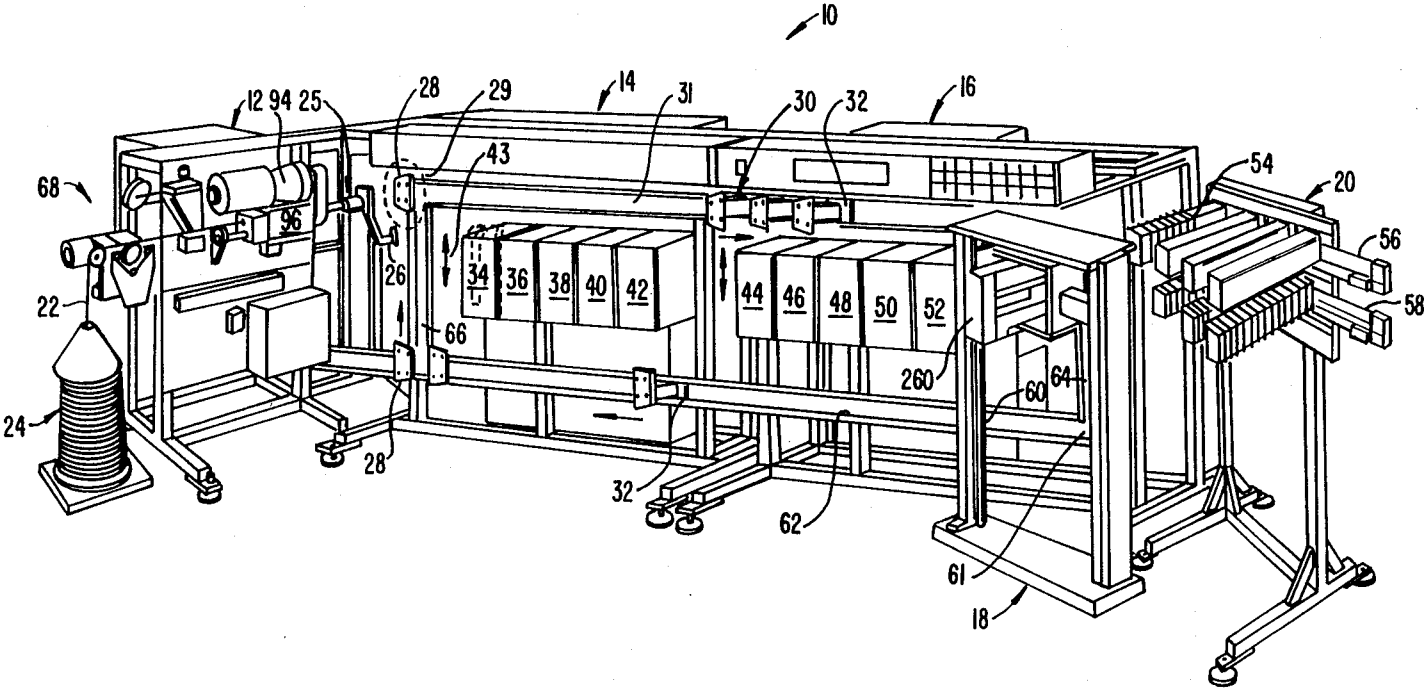
FIG. 1 is an overall perspective view of a coil winding machine made according to the present invention.

In FIG. 1, a novel high voltage coil winding machine 10 is illustrated. An overview of the function and structure of machine 10 will first be provided with reference to FIG. 1. The high voltage coil winding machine 10 has several subassemblies including a winding subassembly 12, a heating subassembly 14, a cooling subassembly 16, a winding form manipulator subassembly 18 and a bundle storage subassembly 20. Wire 22 from a bulk supply of wire 24 is fed to the winding subassembly 12 as shown.

The winding subassembly 12 includes a fly winder 25, having a fly winding arm 26, for winding the wire 22 into a pie-shaped coil on a winding form 28 positioned at a winding station 29 along a winding form transfer system 30. The winding subassembly 12 includes the mechanisms and controls (not shown) for winding a pie-shaped coil with a predetermined sequence of turns on the winding forms 28.

The heating subassembly 14 and the cooling subassembly 16 cooperate with the winding form transfer system 30 which transports a plurality of winding form pallets 32, which in turn carry the winding forms 28. The pallets 32, carrying the winding forms 28, are moved rightwardly in FIG. 1, one station at a time, along upper track 31 as each new coil is wound by the winding machine 12. The heating subassembly 14 includes, for example, heating stations 34–42 (shown schematically as boxes). The heating stations 34–42 include heating platens which are vertically movable from a lower station as illustrated in FIG. 1 to an upper station as indicated by the arrow 43. In the upper station, the platens of heating stations 34–42 are positioned and operated to transfer heat to a thermoplastic adhesive coating on the wire of the pie-shaped coil bundles on winding forms 28. As will be described in greater detail hereinafter, each heating station 34 through 42 includes opposing platens which move toward each other into heat-transfer engagement with the pie-shaped coil forms 28 to transfer heat to the thermoplastic wire coating through the coil forms 28. Preferably, the wire 22 has the usual dielectric layer(s) surrounding the conductor, and an additional coating of a thermoplastic adhesive. Such a wire is commercially available as Phelps Dodge BDZ2. As also more particularly described herein below, the temperature of the platens are controlled so that heating station 34 attains the highest temperature to quickly bring the windings up to a bonding temperature, whereas each of the subsequent heating stations 36–42 have relatively lower temperatures to achieve a controlled rate of heating of the thermoplastic wire coating to prevent deleterious overheating of the dielectric layer and to maintain the windings at a temperature sufficiently high to cause generally uniform heating of the thermoplastic coating on the wire 22 throughout the coil bundles to bond the windings into the pie-shaped form provided by the cavity of the winding forms 28. Note that the heating stations 34–42 are lowered upon each indexing of the transfer line 30 to permit rightward movement of the pie-shaped coil forms 28 and are thereafter raised to the upper station to perform the heating and bonding function.

The cooling subassembly 16 includes 5 cooling stations 44 through 52 (shown schematically as boxes) which, like the heating stations 34–42, include platens which move vertically between a lower position in which the winding forms 28 are free to move rightwardly and an upper station in which a pair of platens at each of the cooling stations 44–52 engage opposite sides of the winding forms 28 to reduce the temperature of the winding forms 28, and commensurately, the pie-shaped coils wound onto the winding forms 28. The cooling stations 44–52 are preferably water-cooled using a source of water which can be temperature controlled to provide the appropriate cooling rate of the coil bundles on the winding forms 28 to assure that the coil bundles are sufficiently cool at the end of the cooling cycle to maintain the individual turns of the pie-shaped coil bundles securely affixed to one another in the pie-shaped configuration.

While the preferred embodiment of the present invention uses thermally activated bonding coating on the wire for adhering the bundles, other methods may be used to secure the turns in a pie shape bundle configuration. For example, an adhesive coating on the wire could be activated by a solvent which is applied to the bundles during or after winding to soften the adhesive to adhere after such softening upon rehardening the adhesive. Alternatively, the heat-activated bonding coating could be activated by other forms of heat transfer including radiant heat transfer or electromagnetic (microwave) heat transfer. Still alternatively, the wire could be heated directly by passing a suitable electrical current through the wire itself. Such alternative heating schemes may operate during the winding operation itself and not require addition stations for such heating operations. Furthermore, the wire may be secured in bundles by purely mechanical fasteners adapted to hold the bundles in the pie-shaped configuration as wound.

The winding form manipulator 18 includes a winding form manipulator head (not shown in FIG. 1) which grips and manipulates the front plate and core of each winding form 28 in a fashion to remove the front plate and core from the back plate and pallet. When the front plate and core are removed from the back plate and pallet, the winding is retained on the core so that it may be positioned on coil or bundle storage arbors 54 in the same sequence and positional relationship in which the coils were wound. Note that, to function properly, the completed pie-shaped coil bundles must be maintained in the same sequence and relationship in which they are wound when ultimately formed into a functional part of a toroidal winding. Thus, they must be unloaded from the transfer machine at the unloading station in that sequence and placed upon a storage mandrel or other suitable holding device or fixture. To place them on that storage mandrel in the same order and relationship in which the coils were wound, such that may be conveniently off-loaded from the storage mandrel in that same order to be formed into a toroidal winding with a minimum length of interconnecting wire, the coils must be removed from the back side of the pie-shaped coil winding forms. If, on the other hand, the completed pie-shaped coil bundles were removed from the front side of the pie-shaped coil winding forms, it would be difficult to arrange the coils in the proper order and relationship while maintaining an interconnecting wire of minimum length.

All of the pie-shaped windings of a one-half of a toroidal primary winding of a transformer are carried by a single coil storage arbor 54. Note that the coil storage subassembly 20 includes several coil storage arbors 54, up to a total of 10. The coil storage arbors 54 are cycled from right to left on the top rail 56 to receive newly wound pie-shaped windings when in the leftmost position on the top rail. Thereafter, they are moved downwardly to the lower rail 58 and then rightwardly for eventual removal to permit transport of the completed toroidal winding sections to the next assembly station.

Figure 12:
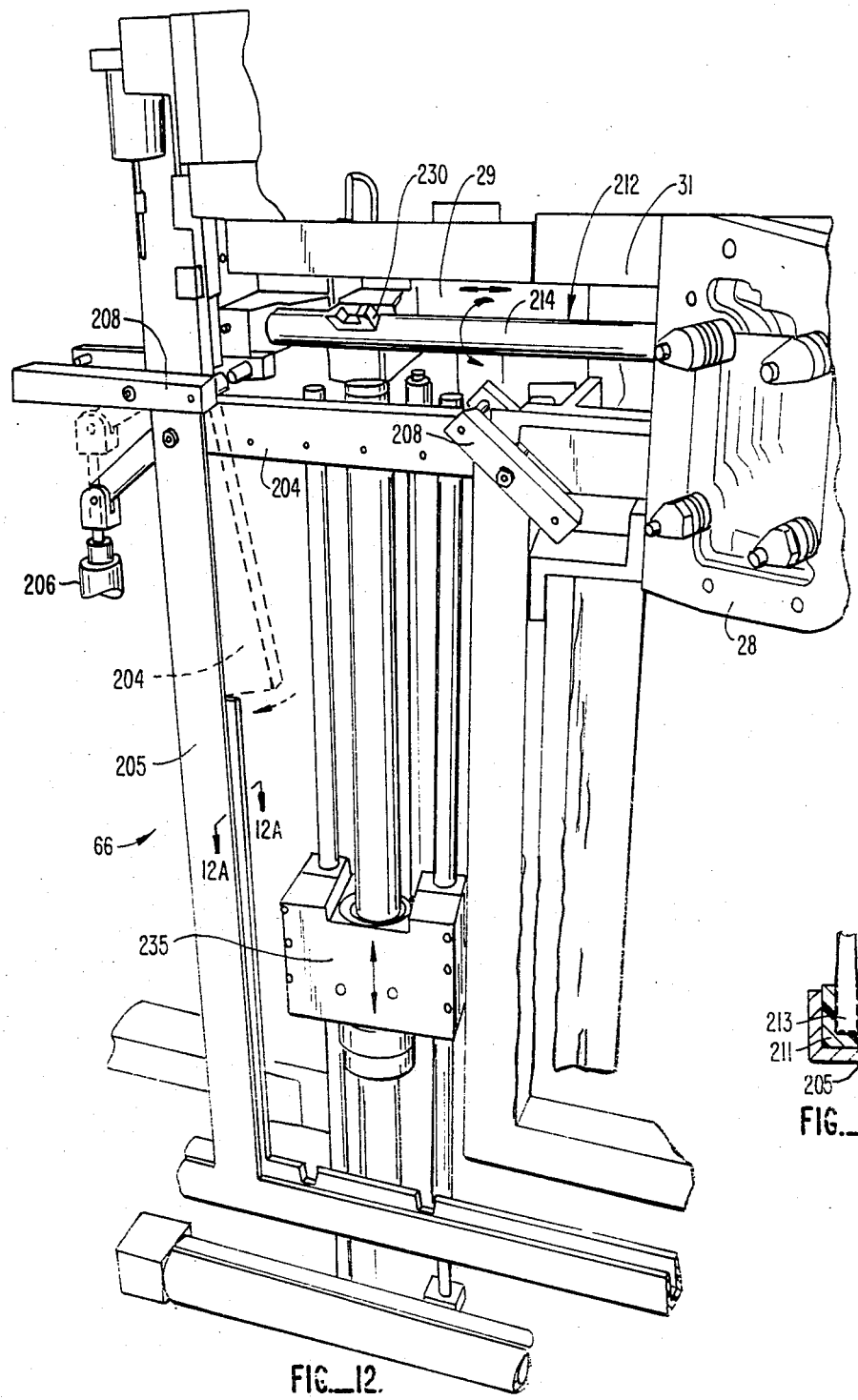
FIG. 12 is a perspective view of the winding station and the upward transfer track of the winding form transfer system of FIG. 1.
Figure 12A:
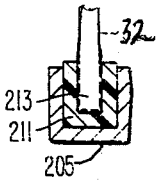
FIG. 12A is a cross-sectional view of a portion of the side guide rail of the upward transfer track taken along line 12A—12A of FIG. 12 with the edge of a pallet shown in dashed lines.
Figure 12B:
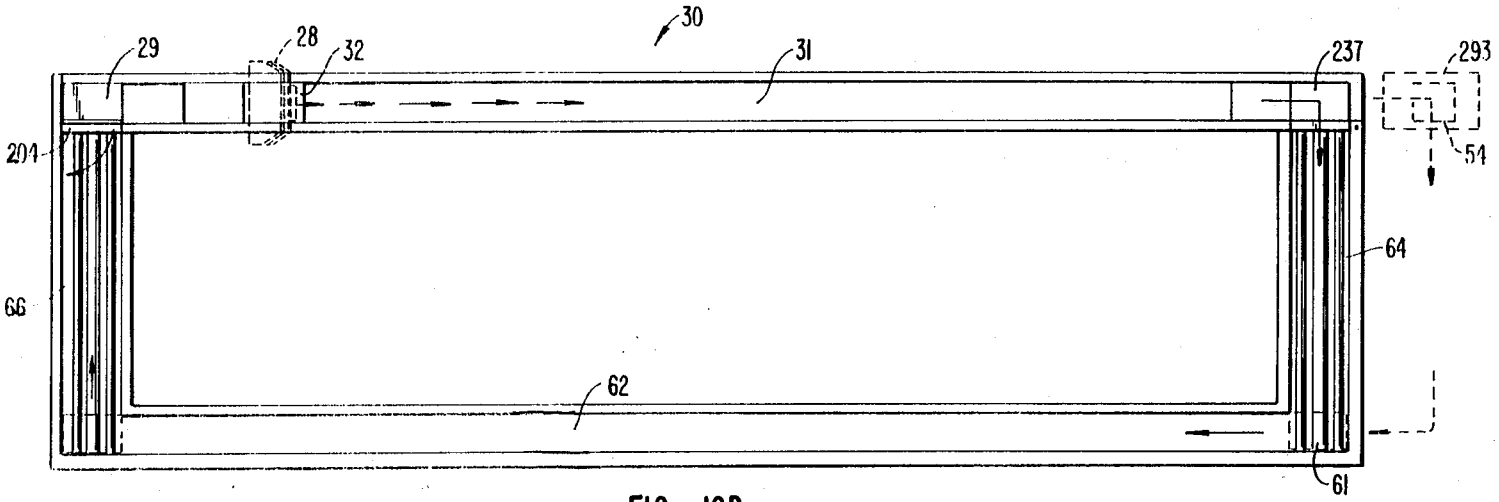
FIG. 12B is a simplified representation of the tracks of the winding form transfer system of FIG. 1.
Figure 22B:
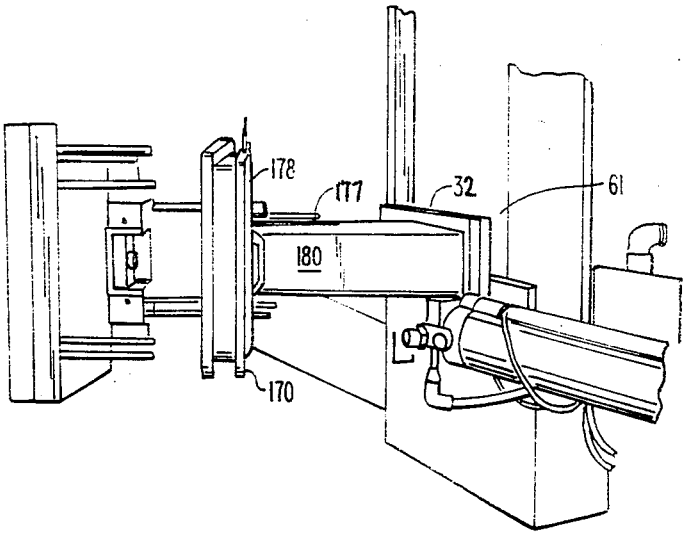
FIG. 22 is an overview of the coil storage subassembly of FIG. 1.
FIG. 22A is a detailed perspective view of the reassembly station illustrated schematically in FIG. 12B.

After the winding form manipulator subassembly 18 has removed the outer or front plate and core of the winding forms 28, and placed the completed bundle or coil on the coil storage arbor 54, the winding form manipulator head reassembles the front plate and core to the back plate and platen at reassembly station 61, shown in FIG. 12B and detailed in FIG. 22A. This, however, requires further operations of the tooling manipulator and the pallet transfer system. Particularly, when the front plate and core is removed from the back plate and pallet assembly by the winding form manipulator head, the remaining back plate and pallet must be moved downwardly, out of the way of the next pallet and winding form 28 so that the coil can be repositioned by the winding form manipulator arm onto the coil storage arbor 54. Because of the constraint of the predetermined limited length of the interconnecting lead between coils or bundles, both the next winding form 28 in the sequence and the front plate and core of the now disassembled winding form 28 must move simultaneously rightwardly, the former in the upper track 31 and the latter while being held by the tooling manipulation subassembly 18. Prior to such rightward movement, the back plate and pallet of the same winding form 28 moves downwardly on a rail or track 64 (not shown completely in FIG. 1) towards station 61 so that the next winding form 28 can move simultaneously rightwardly into the position just vacated by the preceding winding form. That sequence of movements, including the simultaneous movement of the disassembled winding form 28 and the next winding form in the sequence, allows the winding to be placed on the coil accumulation arbor 54 without overextending the interconnecting lead between the sequential coils.

In view of the above, the back plate and platen of the now-disassembled winding form 28 must be transferred downwardly on the downward transfer track 64 before the bundle wound in that winding form 28 has been placed on the coil storage arbor 54. Winding form manipulator subassembly 18 is constructed to allow the winding form manipulator head, and the disassembled winding form 28 carried by it, to move vertically downwardly on vertical ways or tracks 60 and leftwardly on its horizontal carriage to be placed in alignment with the back plate and platen of the disassembled winding form 28 at reassembly station 61, which is located at the intersection of track 64 and lower transfer track 62 of system 30, shown in FIG. 12B. The front plate and core of that same winding form 28 may now be reassembled to its back plate and pallet. Note that adequate time is provided for these movements and operations since the time limiting operation for each movement of the winding form 28 is the winding step itself performed by the winding subassembly 12.

After the winding form 28 has been reassembled, it is moved leftwardly along lower transfer track 62 to be queued at the leftmost end of the track 62 with other empty winding forms 28.

After one pie-shaped coil or bundle is completed by the winding section 12, its respective winding form 28 and pallet are moved rightwardly on the upper track 31 and the next empty winding form 28 is moved vertically along the upward transfer track 66 to take its place as the next winding form 28 on which a pie-shaped coil will be wound by the winding subsection 12. By this means, a continual supply of winding forms 28 are presented by the winding form transfer system 30 to the winding station for winding of successive pie-shaped coil bundles.

In view of the foregoing overview of the high-voltage coil winding machine 10, it will be appreciated that successive pie-shaped coil bundles are wound onto winding forms 28 by the winding subassembly 12. The successive pie-shaped coil bundles are interconnected by the wire 22 used to wind the pie-shaped coil bundles. The length of the connecting wire 22 between sequential pie-shaped coil bundles is of a minimal length only slightly longer than that required for interconnecting the pie-shaped coil bundles when arranged to form a toroidal winding for a transformer. In the preferred embodiment, depending on the coil geometry selected, that length varies from approximately 60% longer than the required interconnecting length to approximately the same length as the required interconnecting length. Thus, it is always less than twice the required interconnecting length.

By way of example, but not as a limitation, a typical toroidal transformer winding may consist of two winding sections, each having 10–30 interconnected pie-shaped coil bundles.

As an important advantage of this invention, already wound pie-shaped coil bundles of an interconnected set of such bundles can be subjected to post-winding operations while later bundles in that same interconnected set are being wound. In the particular preferred embodiment, such already wound pie-shaped coil bundles are heated to cause a thermoplastic coating over the dielectric insulation layer of the wire 22 to fuse or adhere contacting turns at the heating stations 34–42 and are thereafter cooled to set the adhesive coating at cooling stations 44–52 while subsequent bundles of that interconnected set are being wound by the winding subassembly 12. The turns of individual bundles are therefore secured in the pie-shaped configuration to facilitate later handling of the bundles. The individual interconnected bundles are then off-loaded, one at a time, onto the bundle storage arbor 54 at the unloading station of the winding form transfer system 30 while the final bundles in the set are being wound.

Importantly, the bonding operations occur simultaneously with the winding operations to improve the efficiency and throughput of the machine 10. Additionally, the manipulations of the interconnected bundles are performed while maintaining the bundles in winding sequence as required for transformer operation and not exceeding the spacing limitation imposed by a predetermined minimum length of the interconnecting wire. Overall, the high-voltage coil winding machine 10 represents a continuous processor with the time-limiting operation, in the preferred embodiment, being the time required for the winding subassembly 12 to wind the individual pie-shaped coils. Thus, the process of winding individual interconnected coil bundles continues repeatedly with minimal pause or interruption for substituting an empty winding form 28 for the previously filled winding form 28. Also, contrasted to the previous machines described above, there is no requirement to interrupt the winding operation after a set of pie-shaped coil bundles have been completed to remove the mandrel containing the completed set and replace it with an empty mandrel. Finally, it will be appreciated that the high-voltage coil winding machine 10 is highly automated and requires minimal manual intervention or supervision.

Figure 2:
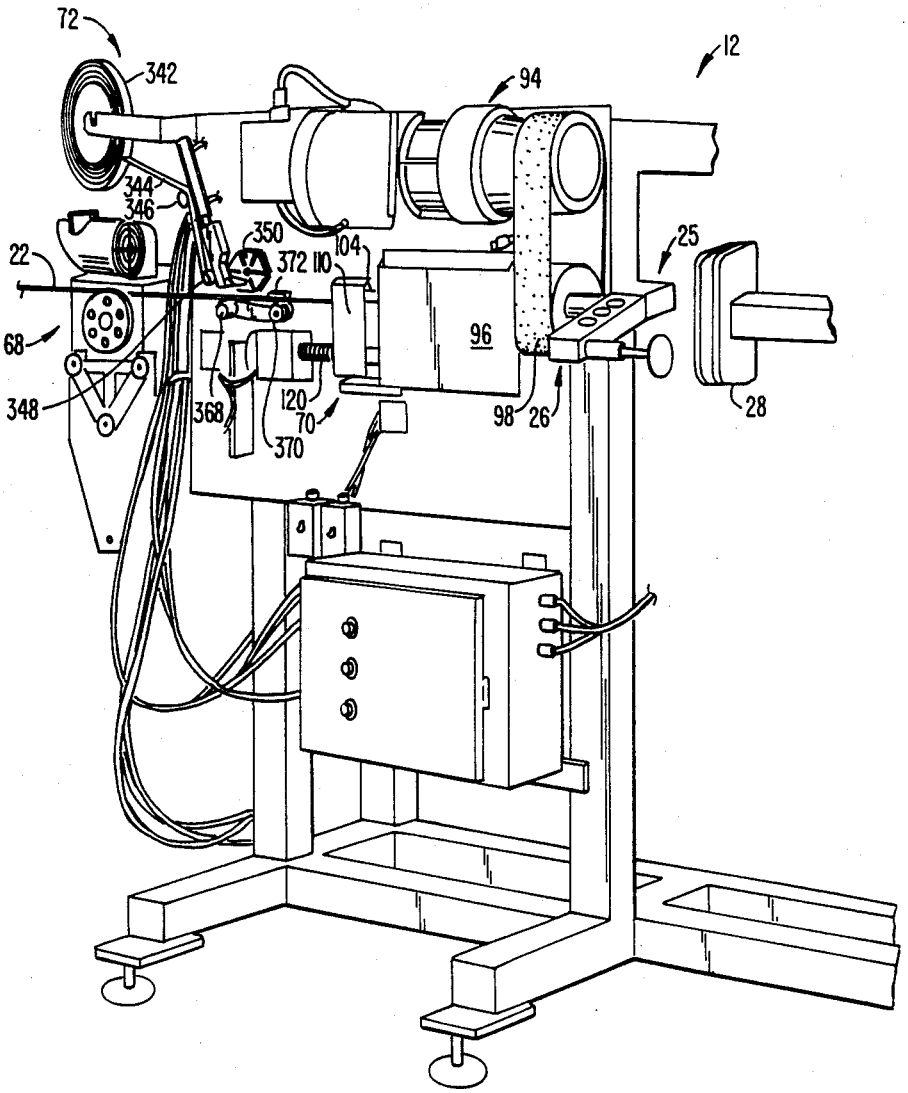
FIG. 2 is a perspective view of the winding subassembly of FIG. 1.

With specific reference now to FIG. 2, the winding subassembly 12 is seen to include a dynamic wire tensioning and control unit 68, a winding head drive and control unit 70 and an optional tape applier 72.

The dynamic wire tensioning control unit 68 applies a tension to the wire 22 in a dynamic fashion. That is to say, the wire is not only retarded in its path to the winding head drive, it is also dynamically driven backward such that when slack occurs at the fly winder 25, the dynamic wire tensioning and control unit 68 withdraws the wire by reversing its direction while maintaining the desired tension on the wire 22. Additionally, the dynamic wire tensioning and control unit 68 includes a provision for sensing a wire break or outage, indicated by a reverse movement of the wire 22 beyond that required to take up normal slack, to shut down the coil winding machine 10.

The winding head drive control unit 70 controls the fly winding arm 26 so as to provide controlled rotation of the fly winding arm 26 in both rotational directions and to provide controlled back and forth movement along the axis of rotation of the fly winding arm 26 in a predetermined relationship with the rotation of the fly winding arm 26. The controlled rotation and back and forth movement of the fly winding arm 26 is predetermined to wind the pie-shaped coil bundles with a particular winding pattern (described hereinafter) and to provide and control the interconnecting wire between sequential pie-shaped coil bundles. The winding head drive and control unit 70 operates in conjunction with a positioning measuring unit (described hereinafter) for determining the position of the inside surface of the winding forms 28 and a lead clamp unit (described hereinafter) for directing the starting turn of each pie-shaped coil bundle and establishing the length of the interconnecting lead between sequential pie-shaped coil bundles.

Figure 3:
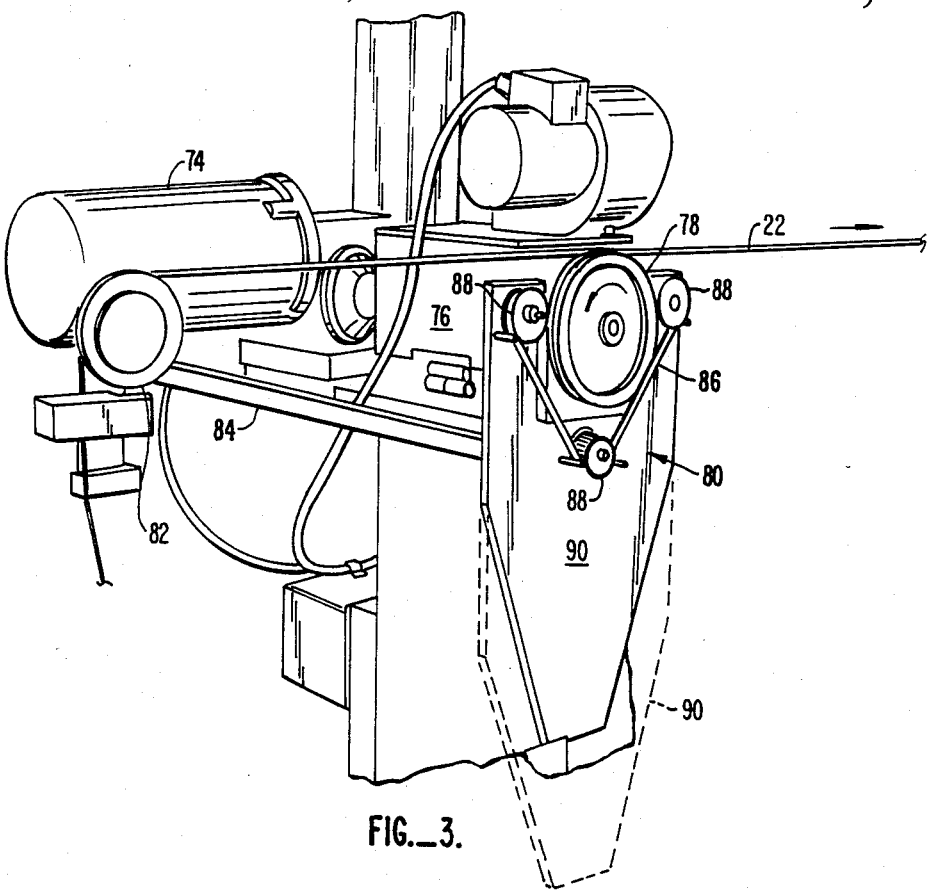
FIG. 3 is a perspective view of the dynamic wire tensioning and control unit of FIG. 2.

With reference now to FIG. 3 in which a more detailed presentation is made of the dynamic wire tensioning and control unit 68, the functioning of that unit will be explained in greater detail.

The dynamic wire tensioning and control unit 68 includes a gear reduction drive motor 74, a magnetic clutch assembly 76, a tensioning wheel 78, a tensioning belt and pulley unit 80 and a lead-in guide pulley 82 mounted on arm 84. The dynamic wire tensioning and control unit 68 functions as follows. The gear reduction drive motor 74 drives the tensioning wheel 78 through the magnetic clutch assembly 76 in the direction opposite the normal direction of feed of the wire 22 from the bulk supply 24 to the fly winding arm 26. The torque applied to the tensioning wheel 78 is controlled at a constant level by controlling the current applied to the magnetic clutch of the magnetic clutch assembly 76. Thus, the tensioning wheel 78 is driven in opposition to the normal direction of feed of the wire 22 with a constant torque. The wire 22 passes over the lead-in guide pulley 82 and is wrapped preferably once around the tensioning wheel 78 to obtain adequate friction between the tensioning wheel 78 and the wire 22. Of course, more than turn can be used if desired.

The tensioning belt and pulley unit 80 includes a tensioning belt 86 which engages three pulleys 88, preferably by means of engaging teeth on the tensioning belt 86 and the pulleys 88. The pulleys 88 are mounted as shown on a mounting plate 90 which is movable vertically between two stations by a pneumatic cylinder (not shown). When the mounting plate 90 is in its upper position, as shown by the solid lines of FIG. 3, the tensioning belt 86 surrounds approximately one-half of the periphery of the tensioning wheel 78. The tensioning wheel 78 preferably has an elastomeric covering on its outer surface which has a controlled friction characteristic.

It has been discovered that the wire 22 wrapped around the tensioning wheel 78 must be allowed to slide laterally (axially) on the surface of the wheel to allow the existing turn on the tensioning wheel 78 to move laterally to provide room for new wire being supplied to the tensioning wheel. If the lateral sliding is not provided for, the new wire being wound on the tensioning wheels 78 tends to climb on top of the existing turn and may crawl over the rim of the tension wheel to cause a jam. The lateral (axial) movement of the wire 22 on the periphery of the tensioning wheel 78 is accommodated by a flat (cylindrical) surface on the periphery of the tensioning wheel 78.

As an alternative to the existing design of the tensioning wheel 78 using a flat (cylindrical) periphery, the tensioning wheel can be provided with a central circumferential groove which contains only a partial turn (rather than one or more turns as described above) of the wire about the lower portion of the tensioning wheel 78. The partial turn can be increased or decreased in circumferential extent by repositioning of the pulleys 88 located to the sides of the tensioning wheel 78. For example by locating the side pulleys 88 upwardly, approximately 270 degrees of engagement of the partial turn with the tensioning wheel 78 can be provided. In this alternative configuration, a higher friction elastomeric surface can be provided on the outer surface of the tensioning wheel 78 since lateral slippage is not required. In such a construction, since the wire 22 is fed from the bottom of the tensioning wheel 78 rather than from the top, the direction of rotation of the tensioning wheel 78 would be opposite that shown in FIG. 3.

When the mounting plate 90 is in the upper position. the outer surface of the tension belt 86 engages the turns of wire 22 on the tensioning wheel 78 to maintain those turns in close frictional relationship with the driving surface of the tensioning wheel 78.

With the arrangement above described, the controlled torque on the tensioning wheel 78 provides a controlled tension on the wire 22 as it is fed to and from the fly winding arm 26. At certain times in the winding cycle of the pie-shaped coil bundles, slack occurs in the wire 22 which must be immediately taken up by the dynamic wire tensioning and control unit 68. This occurs because the tensioning wheel 78 is "driven" through magnetic clutch assembly 76 in the opposite direction of the normal feed of the wire 22 to return or backup the wire 22 which had previously been fed to the fly winding arm 26. Normally, this backing-up action would cause the turns of the wire 22 on the tensioning wheel 78 to loosen, thereby eliminating the friction between the turns of the wire 22 and the tensioning wheel 78. However, in the dynamic wire tensioning and control 68 as described, this loosening and reduction in friction does not occur by virtue of the friction applied by the tensioning belt 86. Thus, upon the backing up of the wire 22 when slack occurs at the fly winding arm 26, the wire is driven backward toward the leading guide pulley 82 under the controlled tension provided by the magnetic clutch assembly 76. This controlled tension on the wire 22, even during backing up caused by slack at the fly winding arm 26, provides significant advantages to the present invention.

The dynamic wire tensioning and control unit 68 is provided with a wire breakage (or exhausted supply 24) sensor and alarm which shuts down the winding machine 10. This is accomplished by detecting reverse rotation of the tensioning wheel 78 in excess of that normally required to take up slack. Upon the detection of such excess rotation, e.g. approximately one rotation of a 5 inch diameter wheel representing more than 15 inches of reverse take-up, the machine is shut down through its control unit and an alarm is sounded.

To disengage the tensioning belt and pulley unit 80, e.g. to replenish the supply 24 of wire 22, the air cylinder (not shown) moves the mounting plate 90 downwardly to the position illustrated by dashed lines to disengage the tensioning belt 86 from the periphery of the pulley 82.

Figure 4:
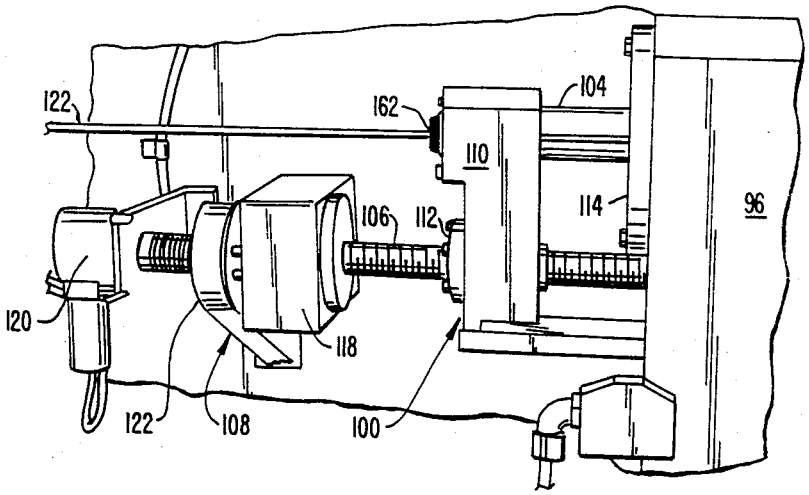
FIG. 4. shows an enlarged view of the left-hand portion of the winding head drive control unit of FIG. 2.
Figure 5:
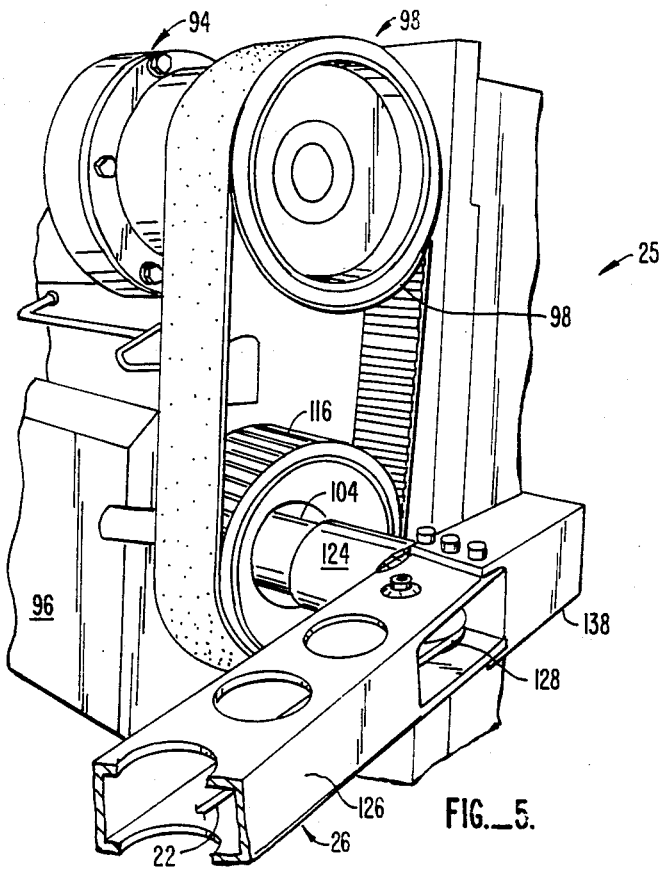
FIG. 5 illustrates the right-hand portion of the winding head drive control unit of FIG. 2.
Figure 6:
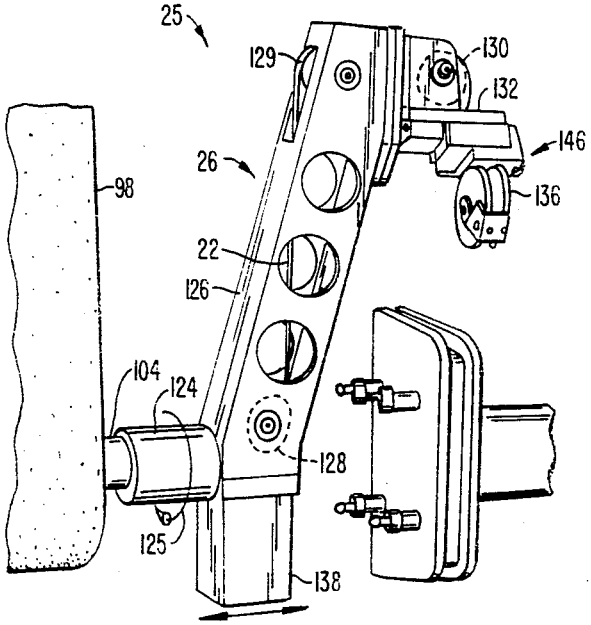
FIG. 6 shows the fly winder of FIG. 1.

With reference now to FIGS. 4 through 6, the winding head and control unit 70 will be described in greater detail. The winding head drive and control unit 70 includes a controlled gear-drive motor 94, a winding head housing 96, the previously described fly winding arm 26, a toothed-belt drive 98, a fly winding arm positioner 100 and an arm positioner drive motor, not shown.

The winding head housing 96 carries a winding arm drive spline 104 which is driven by the controlled gear drive motor 94 through the toothed-belt drive 98. The winding head housing 96 also carries a drive screw 106 which is driven by the arm positioner drive motor (not shown) through a toothed-belt and pulley arrangement 108. The drive screw 106 is coupled to the winding arm drive spline 104 through a drive brace 110 which is fixed to the winding arm drive spline 104 at its upper end and which carries a drive nut 112 which in turn is engaged with the drive screw 106. Therefore, rotation of the drive screw 106 moves the drive nut 112 and drive brace 110 leftwardly and rightwardly along the axis of rotation of the fly winding arm 26. Movement of the drive nut 112 and drive brace 110 back and forth in the direction of the axis of rotation of fly winding arm 26 similarly moves the winding arm drive spline 104 to move the fly winding arm 26 back and forth along the axis of rotation of the fly winding arm 26. For this purpose, the winding arm drive spline 104 is slidably mounted within a drive carrier 114 (see FIG. 4) which in turn is fixed to a lower drive pulley 116 (see FIG. 5) of the toothed-belt drive 98. The drive spline 104 is slidably mounted within the drive carrier 114 for the back and forth movement of the drive spline 104 along the axis of rotation of fly winding arm 26 while being rotated by the toothed-belt drive 98. In the preferred embodiment, the back and forth movement of the drive spline occurs in a predetermined relationship with the rotation of the winding arm 26 to provide a predetermined winding pattern under control of a programmable controller as described herein below.

The winding head housing 96 also carries suitable bearings to support the drive screw 106 for rotation. The drive screw 106 is also supported by bearings mounted within the drive screw mount 118.

A rotary position encoder 120 is attached to the end of the drive screw 106 adjacent the drive screw pulley 122 to sense the rotational position of the drive screw 106, and hence, the axial position of the fly winding arm 26 along its axis of rotation. The position indicating signal provided by the rotary position encoder 120 is provided to the computer numerical control as a feedback signal for controlling the operation of machine 10.

With respect to FIGS. 5, 6 and 8, fly winding arm 26 will be described in greater detail. Fly winding arm 26 includes a boss 124 which is mounted on the end of the winding arm drive spline 104. The winding arm extension 126 is secured to the boss 124 and in turn carries winding arm guide pulleys 128, 129 and 130. The winding arm extension also carries an L bracket 132. A winding guide assembly 146 is pivotally mounted to the L bracket 132. A counter weight 138 is carried by the boss 124 opposite the winding arm extension 126 to approximately balance the fly winding arm 26 about its axis of rotation.

Figure 7:
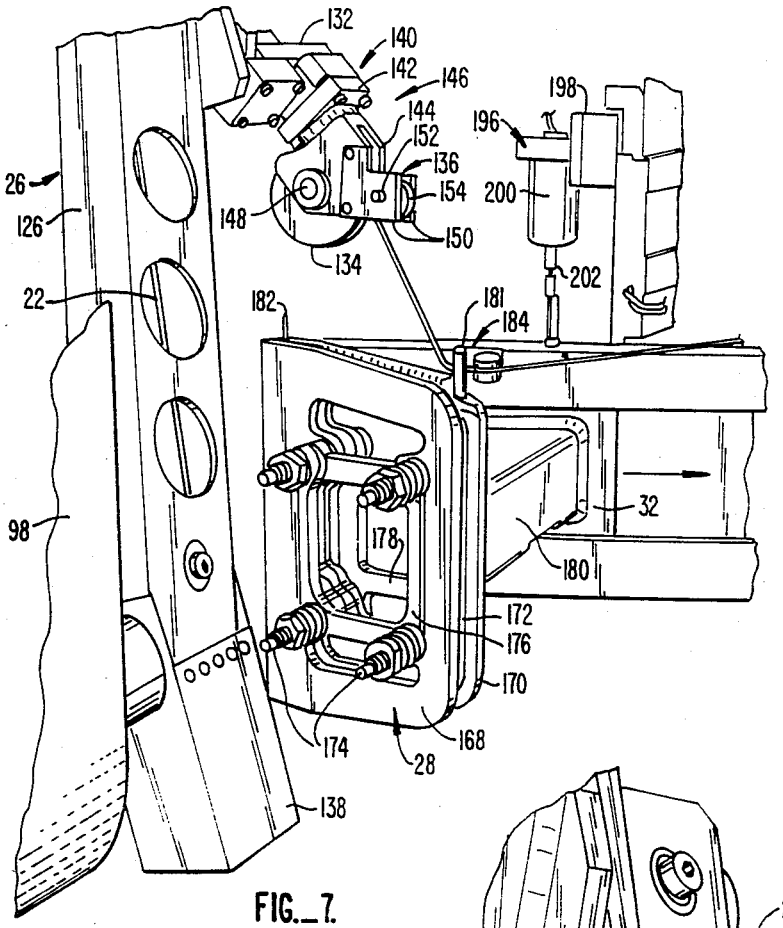
FIG. 7 illustrates the start of winding wire onto a winding form by the fly winder.
Figure 8:
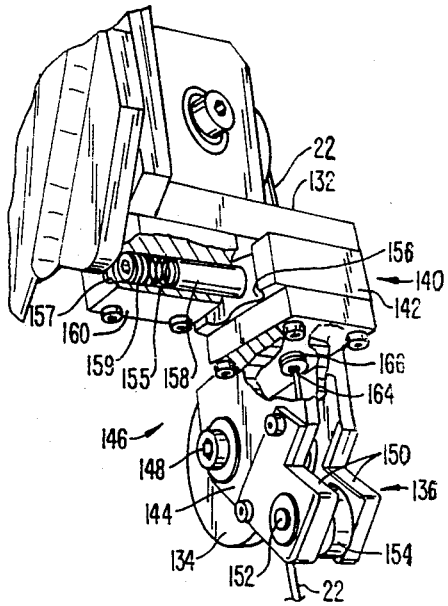
FIG. 8 is an enlarged view of the pivot bracket assembly of FIG. 7.

In FIGS. 7 and 8, an enlarged view of the winding guide assembly 146 is shown. Assembly 146 includes a winding pulley 134 and winding guide 136. Particularly, the winding pulley 134 and winding guide 136 are mounted on a pivot bracket assembly 140 which includes a base block 142, a pulley mounting yoke 144, which is bifurcated to receive the winding pulley 134, see FIG. 8. Note that the winding pulley 134 is mounted within the bifurcated pulley mounting yoke 144 via an axle 148.

The winding guide 136 includes a pair of axle mount brackets 150 which mount an axle 152 which allows rotation of a guide wheel 154. Note that the guide wheel 154 rotates about an axis which is parallel to the axis of rotation of the winding pulley 134 and that the diameter of the guide wheel is substantially less than the diameter of the winding pulley. Additionally, while the winding pulley 134 has a groove for receiving the wire 22, the guide wheel 154 is grooveless. As explained hereinafter, the guide wheel 154 accommodates reverse rotation of the winding arm 26.

In FIG. 8, base block 142 is shown to include an accurate recess 156 for receiving a spring-loaded nylon stop 158. The nylon stop 158 is mounted in a stop member mounting block 160 and is spring-biased by a compression spring 155 residing in a threaded bore 157. An adjustment screw 159 engages the threaded bore 157 for varying the compression of the spring 155 to vary the force that the nylon stop 158 exerts upon the arcuate recess 156 in base block 142. Thus the springbiased stop member 158 cooperates with the arcuate recess 156 to limit the pivoting of the pivot bracket assembly 140 and provides a frictional dampening of the pivoting of the pivot bracket assembly 140. The pivot bracket assembly 140 is rotationally balanced at its pivot axis to limit the degree of gravity bias to the pivoting of the pivot bracket assembly 140 as the winding arm 26 rotates through its 360 degree cycle.

When the winding machine 10 is in use, the wire 22 is fed from the bulk source 24 over the lead-in guide pulley 82, as shown in FIG. 3, and is wrapped around the tensioning wheel 78. Thereafter, the wire 22 is fed through a central bore 162 (see FIG. 4) of the drive spline 104 and emerges interiorly of the boss 124 of the fly winding arm 26. Thereafter, the wire 22 is fed over the winding arm guide pulleys 128, 129 and 130. From the final winding arm guide pulley 130, the wire 22 is fed through the bore 164 (see FIG. 8) of the pivot axle 166 to the winding pulley 134 and the guide wheel 154. Thereafter, the wire 22 leaves the winding arm 26 and extends to the winding form 28 for winding of a pie-shaped coil upon rotation of the winding arm 26 about the winding form 28.

FIG. 7 shows winding form 28 and its associated winding form pallet 32. Winding form 28, see FIG. 9B, includes a front plate 168 and a rear plate 170. A generally trapezoidal core 172 is sandwiched between the front plate 168 and rear plate 170, both of which are also preferably generally trapezoidal in form. The core 172 is fixed to the front plate 168 and is removable from the rear plate 170 by means of four plunger/ball release rods 174 (see FIG. 10). The four plunger/ball release rods 174 reside in bores provided by a plunger bracket 176 which is fixed to the front of the front plate 168. The plunger/ball release rods 174 extend through the front plate 168 and the core 172 and into mating bores on a rear bracket 178 attached to the rear plate 170. The plunger/ball release rods include radially-extendable balls at their opposite ends which lock the plungers to the rear bracket 178, and therefore, attach the front plate 168 with the core 172 to the rear plate 170. This is described in more detail below with reference to FIG. 17. The rear plate 170 and rear bracket 178 are fixed to a mounting arm 180, which in turn is attached to the pallet 32. The mounting arm slants away from the pallet 32 as illustrated in the drawings, for reasons to be explained.

The winding forms 28 are angulated with respect to the pallet 32, and thus the direction of transfer along the upper transfer track 31, to provide adequate clearance for rotation of the winding arm 26 around the winding form 28. Particularly, adequate clearance to the left of the winding form 28 is provided by the fact that the winding station 29 is located at the leftward extremity of the transfer rail so that the winding arm 26 does not engage the transfer rail on rotation to the left side of the winding form 28. On the right side of the winding form 28, clearance is provided by the angulated winding forms 28 since the winding arm 26 will rotate in front of the next adjacent winding form 28. Had the winding forms 28 been mounted parallel to the pallet 32, and thus the upper transfer track 31, rotation of the winding arm 26 to the right of the winding form 28 would cause interference with the next adjacent winding form 28, or alternatively, would have required an excessively long interconnecting lead between wire bundles to provide the necessary spacing of the winding forms 28.

The top portion of the rear plate 170 includes an entry guide pin 181 and an exit guide pin 182. Note that the entry guide pin 181 is somewhat larger in diameter than the exit guide pin 182. The entry guide pin 181 and the exit guide pin 182 cooperate with the wire 22 to control its path at the beginning and end, respectively, of the winding of each pie-shaped coil.

Note that the back upper inside edges 183 of the rear plate 170 of each winding form 28 are substantially rounded. This rounded edge provides a generous radius for the wire 22 as it enters and leaves the winding cavity to limit the degree of bending of the wire as it traverses the inside upper corner of the winding form 28.

Figure 10:
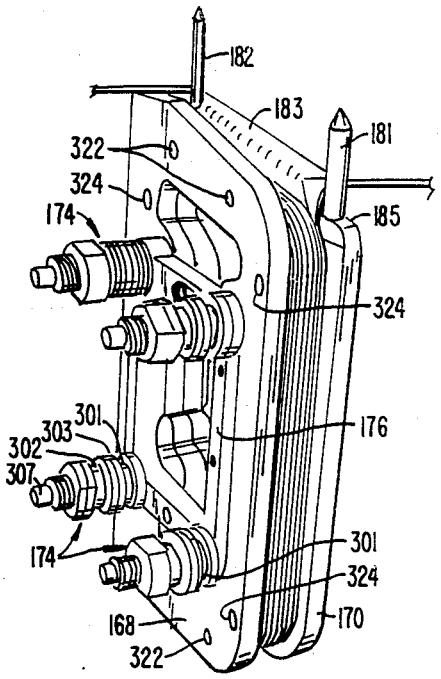
FIG. 10 is a perspective view of the winding form of FIG. 7 after being filled with wire.

The exit guide pin 182, as seen in FIG. 10, is approximately one inch from the leftward top edge of the rear plate 170 on which it is mounted. This location of the exit guide pin 182 causes the last leg of the last turn to closely conform to the surface of the wound coil so that the wire of such last leg is bonded to the wound coil over a substantial length of the radially inside leg during the bonding operation. With the exit guide pin 182 in its inboard position, the last turn as it traverses the radially-inside leg of the coil is not spaced away from the coil body upon exit from the coil, and therefore, will adhere to the coil body during the bonding operation. In summary, the inboard location of exit pin 182 causes closer conformance of that radially inside last turn to the coil body to facilitate the bonding over the entire length of the radially-inside leg portion of the coil.

The inside face of the coil winding form has an inset 185 which contains the entry guide pin 181. The entry guide pin 181 and the exit guide pin 182, in combination with the rounded upper inside edge 183 of the rear plate 170, are configured and positioned to provide a spiral curve to the wire as it enters and leaves the coil and traverses to the adjacent coils. This spiral conformation provides a less severe radius than a circular conformation resulting in less work hardening of the wire at that radius. This, in turn, facilitates the manipulation of the excess wire between the coils upon completion of the winding to lay that excess wire against the upper leg of the turns and to minimize the space required by such excess wire.

Under different conditions it may be desirable to vary the length of the wire 22 connecting adjacent coil bundles. One way to adjust this length is by varying the height (or distance) that the edge 183 is above the core 172. Increasing such distance increases the length of the wire 22 between the top of the coil bundle and the edge 183 so that after the coil bundles are removed from the winding forms 28, the length of the interconnecting wire is longer than it would have been if the edge 183 were closer to the core 172.

Figure 11:
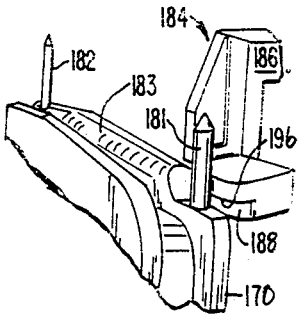
FIG. 11 is an enlarged view of the wire clamp head of FIG. 7.

FIGS. 7 and 11 show a lead wire guide pin clamp 184. The lead wire guide pin clamp 184 includes a clamping head 186 which has a rounded recess 188 for engaging and clamping the wire 22 against the entry guide pin 181. The clamping head 186 also has an inverted shelf 190 for capturing the wire 22 prior to clamping against the entry guide pin 181. The clamping head 186 is mounted on a slide (not shown) which is actuated by a pneumatic cylinder (not shown) for extension of the clamping head 186 into clamping engagement of the wire with the entry guide pin 181 and retraction of the clamping head at other times. As is shown in FIGS. 7 and 11, the clamping head 186 is extended at the start of the winding cycle for each pie-shaped coil to clamp the wire 22 against the entry guide pin 181 and thereby to control the lead wire extending between sequential pie-shaped coils and to position it so as to permit the wire 22 to enter the pie-shaped cavity of the winding form 28 at the start of the winding operation of a pie-shaped coil.

In FIG. 7, the winding form measuring unit 196 can be seen. The winding form measuring unit includes a ball screw slide which carries vertically oriented pneumatically-operated slide 198 which in turn carries a measuring head 200. The measuring head 200 includes a measuring probe 202 which may be brought into engagement with the inside surface of the rear plate 170 of a winding form 28 prior to the start of a winding operation. The probe 202 measures the precise location of the inside surface of the rear plate 170 to provide a reference plane for the computer numerical control (described below) and to accommodate variations in the exact location of winding form 28. Thus, the measurement taken by the probe 202 is provided in digital signal form to the computer and in turn affects the axial position of the winding arm 26 during the winding of the coil on the winding form 28.

With reference now to FIGS. 12, 12A and 12B, a detailed illustration of the winding station 29 of the winding form transfer system 30 is illustrated. The winding station 29 includes a support gate 204 which is movable between the horizontal position as shown and a vertical position within the side guide rail 205 of upward transfer track 66 by a pneumatic cylinder 206. In its horizontal position, the support gate 204 provides a lower platform for supporting the winding form pallet 32 (not shown in FIG. 12 for clarity) of a winding form 28 at the winding station 29. When in that station, the winding form pallet 32 is additionally secured by clamps 208 operated by a pair of pneumatic cylinders 210. Once the winding operation has been completed, the pallet clamps 208 are released, the pallet 32 then in the winding station 29 is transferred rightwardly (by a mechanism described below) and the pallet support gate 204 is then swung downwardly in alignment with the leftward vertical guide rail 205 to permit vertical upward transfer of the next pallet carrying the next winding form 28 into the winding station. Thereafter, the pneumatic cylinder 206 again operates to swing support gate 204 from the vertical position to the horizontal position to provide support for the pallet then positioned in the winding station.

As suggested in FIG. 12A, transfer system 30 guides pallets 32 using U-shaped plastic inserts 211 within the guide rails, such as guide rail 205 illustrated, of system 30. Peripheral flanges 213 of pallet 32 are positioned within inserts 211 and guide pallets 32 about system 30.

Preferably, the support gate 204 has a lock pin (not shown) operated by a pneumatic cylinder to secure the gate in a horizontal position, similar to the lock described with respect to that used with the downward transfer track 64, described below. These locks prevent the gates from dropping to a vertical position in the event of a loss of air pressure on the cylinders which otherwise hold the gates in their horizontal position.

After the winding operations are completed, the pallets 32 carrying the winding forms 28 are moved rightwardly along the linear upper transfer track 31, through a mechanism described hereinafter, through first heating stations 34–42 and thereafter cooling stations 44–52 as shown in FIGS. 13A–13G.

With reference now to FIGS. 13A–13G, the construction and operation of heating stations 34–42 will be described in greater detail. Each heating station 34–42 includes a pair of opposed heating platens or jaws 380 and 382, each of which is preferably surfaced with a heat-conducting elastomeric material 383 such as that sold under the designation 7C-100, by CHR Industries, Inc. of New Haven, Conn. 06509. Since the elastomeric material 383 which faces the platens 380 and 382 is relatively incompressible, e.g., like water, a number of holes 385 have been punched through the facing material. The total area of the through-holes amounting to approximately 10% of the total face area allows for elastic deformation of the elastomeric material 383 under compression. That is to say, when the platens 380 and 382 are closed upon a winding form 28, the elastomeric material facing the platens 380 and 382 is allowed to expand laterally to partially fill the voids provided by the through holes. This permissible deformation of the elastomeric material 383 accommodates variations in the surfaces of the winding forms 28 of as much as 0.13 mm.

The platens 380 and 382 are each provided with internal cartridge-type electric resistance heaters 510 mounted in complementary vertical bores in the platens. The heater 510 receives a supply of heating current through suitable electrical conductors 384, 386 and 388 (and three on the bottom of the front platen which are shown only in FIG. 13G). Each conductor supplies a respective one of the six internal heaters 510 in the front platen 380. A similar set of five conductors supply current to five cartridge-type electric resistance heaters 510 in the rear platen 382. Each heater 510 extends somewhat more than half-way through its associated platen 380, 382. Extraction bores 511 extend from the inner ends of the bores housing heaters 510 to permit extraction of failed heaters 510. The rear platen 382 is provided with one less heater cartridge as a result of a pair of cut-outs 390 and 392 which allow passage of the slotted mounting arm 180 (see FIG. 15) which connects each of the winding forms 28 to the pallets 32. Front platen 380 also includes four clearance holes 514 (see FIG. 13G) for receipt of the plunger/ball release rods 174. The platens 380 and 382 are movable in unison from a lower position illustrated in FIG. 13C in which the jaws are positioned below the winding forms 28 to an upper position shown in FIG. 13B in which the winding forms are positioned to engage the respective sides of the winding forms 28. For this purpose, the heating stations 34–42 are mounted on a movable subframe 394 which may be lifted and lowered under the control of vertical lift cylinders (not shown).

Figure 13A:
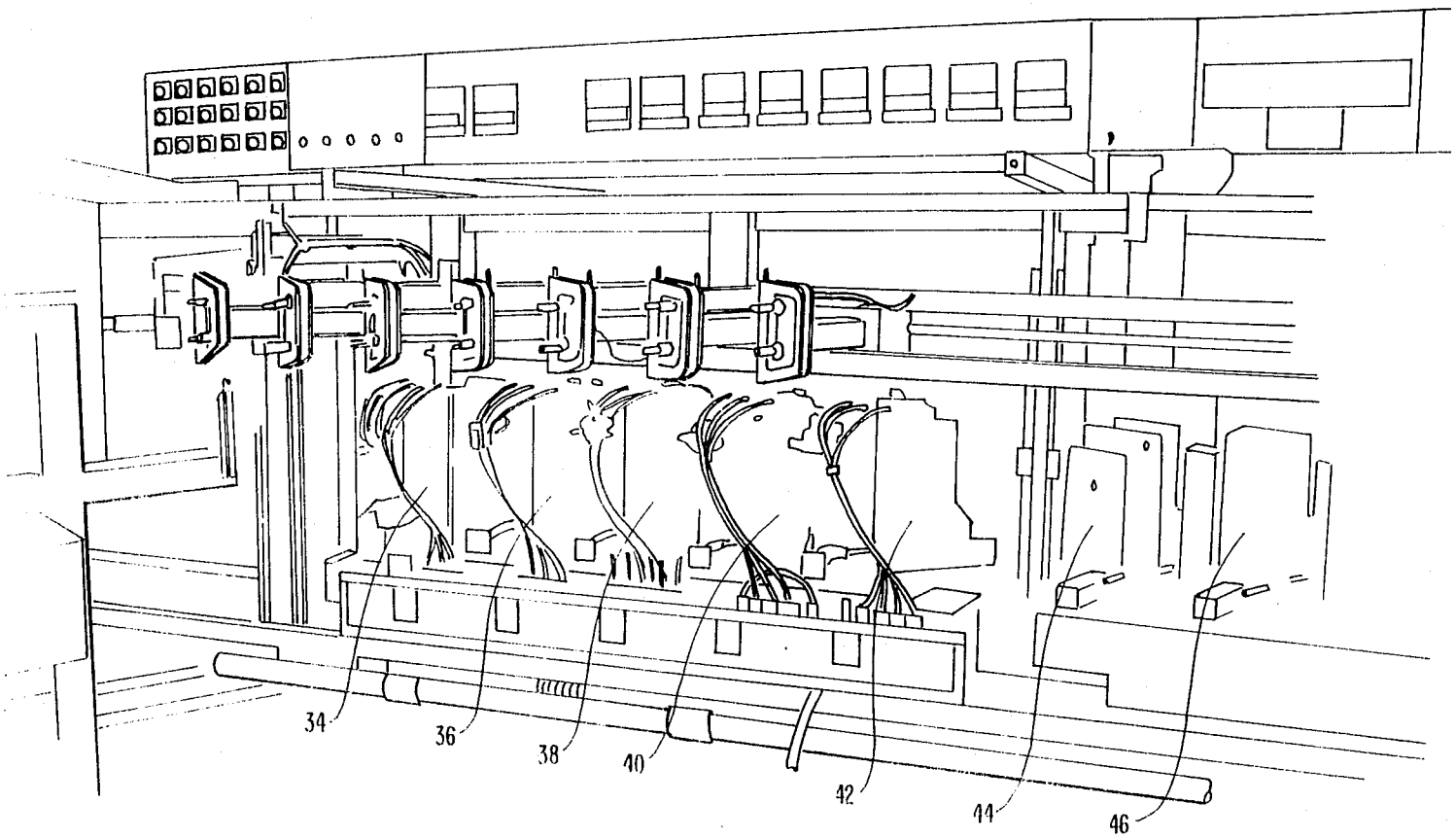
FIG. 13A is a more detailed perspective view of the heating subassembly and a part of the cooling subassembly of FIG. 1.
Figure 13B:
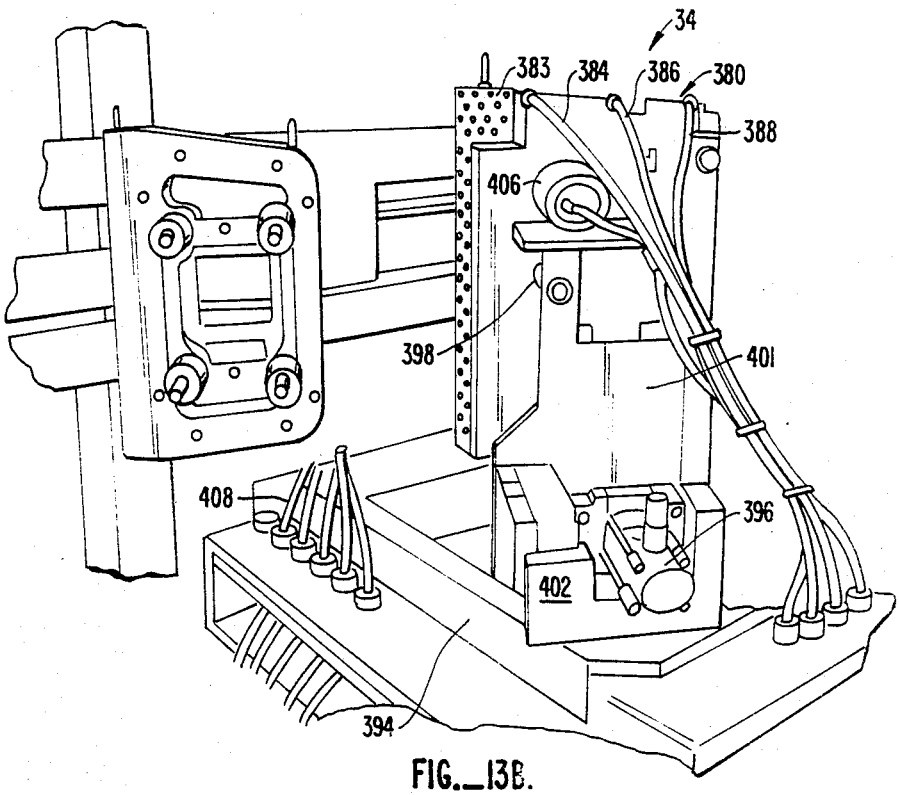
FIG. 13B is a more detailed perspective view of one heating station of the heating subassembly of FIG. 13A with the heating platens in the operative up position.

With reference now to FIG. 13B, a detailed illustration is provided of first heating station 34 in its upward or operative position for heating one respective winding form 28, and in turn, the coil of wire 22 wound on that winding form. In FIG. 13B, a cylinder 396 is illustrated for closing the platens on the winding form 28. The cylinder 396 is free-floating and operates both front and rear platens 380 and 382, respectively. Through the use of a free-floating design, the front and rear platens 380 and 382 self-adapt their position to the position of the winding form 28 and thus accommodate slight variations in the location of the winding form 28. Additional compensation is provided by four mounting springs 398 which mount the platens 380 and 382 to the moveable frame members 400 and 401. The four mounting springs 398 establish a resilient compressive engagement of the platens 380 and 382 with the winding form 28.

The free-floating mechanism by which the cylinder 396 operates the platens 380 and 382 via the moveable frame members 400, 401 operates as follows. The rod of the cylinder 396 is attached to the moveable frame member 400 for the rear platen 382 while the cylinder is attached to the moveable frame member 401 of the front platen 380. The cylinder 396, and the moveable frame members 400, 401 carrying the platens 380 and 382 are mounted on a free-floating base frame 402 which is allowed to move back and forth in the direction of the axis of cylinder 396 on a linear bearing 404 (seen in FIG. 13C). Thus, the position of the free-floating base frame 402 automatically adjusts to accommodate the position of the winding form 28 being engaged.

As also seen in FIG. 13B, an infrared temperature sensor 406 is mounted on the front platen 380 for making measurements of the temperature of the outer surface of the winding form 28. To this end, the front platen 380 has a through-bore 512 (see FIG. 13G) through which the temperature sensor 406 "sees" the outer surface of the front plate 168 of the winding form 28 to receive the infrared radiation emanating from the front plate 168. Insofar as it measures temperature through the infrared band, those temperature measurements are continuously and instantaneously made. The temperature sensor 406 provides a signal to the machine control for assuring that the winding form 28, and therefore the wound coil within the winding form 28, does not exceed a predetermined maximum permissible temperature. Also shown in FIG. 13B are the five conductors 408 for supplying electrical current to the five heaters in the rear platen 382.

Figure 13C:
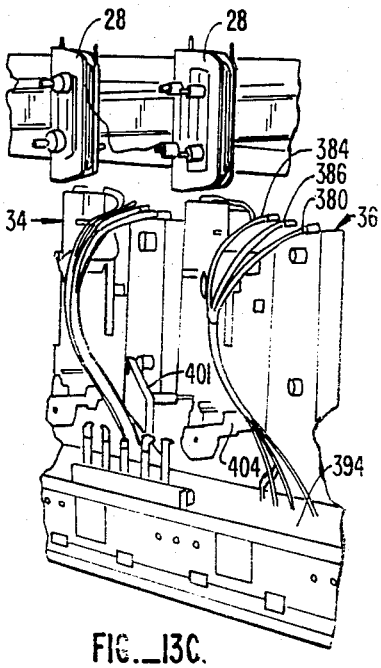
FIG. 13C is a detailed perspective view of two heating stations of the heating subassembly of FIG. 13A with the heating platens in the down position to facilitate indexing of the winding forms.

In FIG. 13C, the front and rear platens 380 and 382 are shown in their down or retracted position which allows the winding forms 28 to index along the upper track 31. As can be seen in FIG. 13C, the platens 380 and 382 and their moveable frame members 400, 401 are mounted on the main frame 394 for upward and downward movement under the control of the previously-described lift cylinders. Also in FIG. 13C, the floating linear bearing 404 can be seen on which the moveable frame members 400, 401 are mounted for movement along an axis perpendicular to the winding forms 28.

Figure 9A:
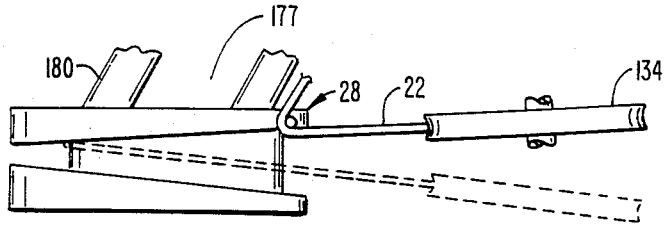
FIGS. 9A–9C are a simplified top, front and cross-sectional side view of the winding form and winding pulley of claim 7 after the fly winding arm has rotated about 180½ from the position of FIG. 7.
Figure 9C:
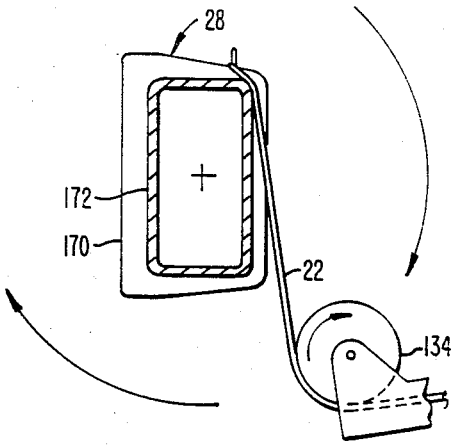
Figure 9B:
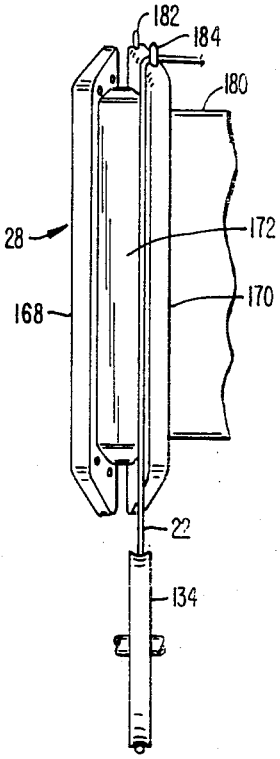
Figure 13D:
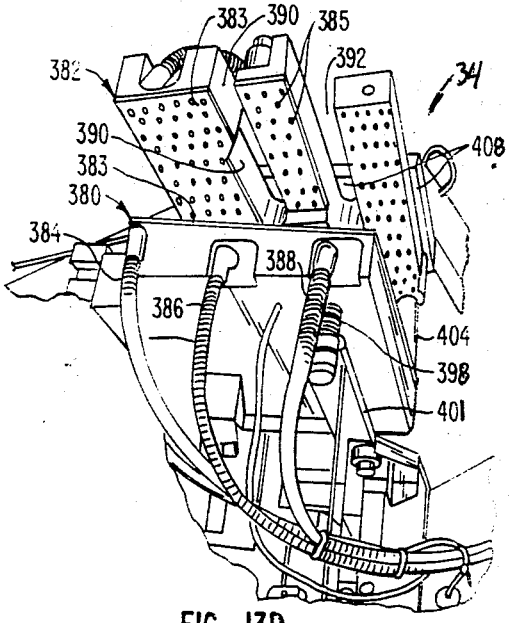
FIG. 13D is a perspective view of one heating station of the heating subassembly of FIG. 13B to illustrate particular features of the heating platen.

In FIG. 13D, a top-down perspective illustration is provided to better show the slots 390 and 392 which receive the vertical sides of the slotted connecting arm 180 extending between the winding form 28 and the pallets 32. Thus, the center member of the rear platen 382 extends into the central slot 177 of the arm 180 adjacent to the winding form 28 (as best seen in FIG. 9A). The arm 180 has slot 177 to permit the rear platen 382 to engage the maximum surface area of the rear plate 170 to in turn provide the maximum rate of heat transfer between the rear platen 382 and the rear plate 170 of the winding form 28. Additionally slot 177 in the connecting arm 180 significantly reduces the cross-sectional area of the arm 180 through which heat can conduct away from the winding forms 28.

Figure 13F:
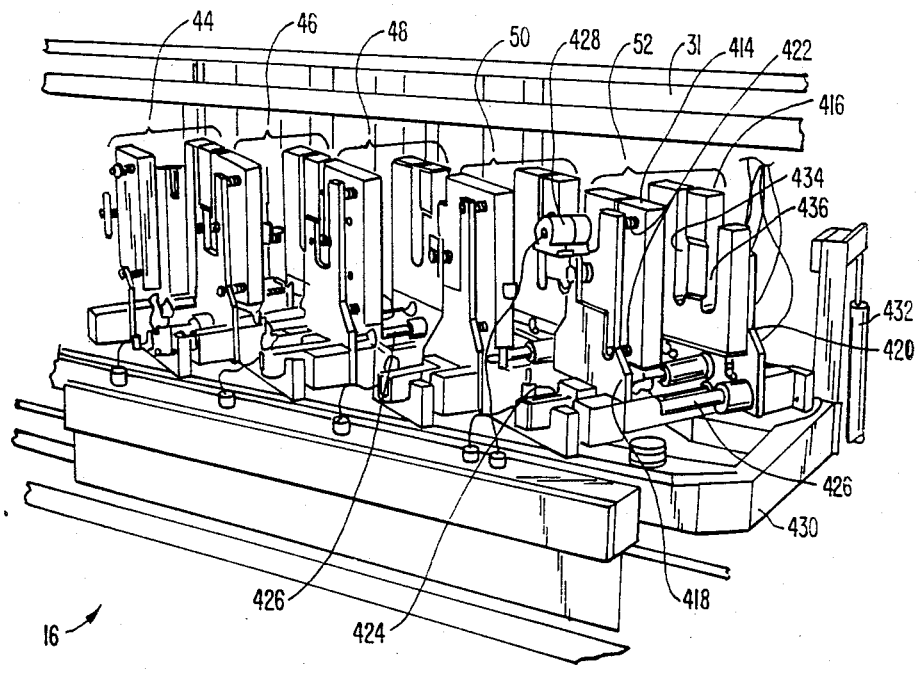
FIG. 13F is a perspective view of the cooling subassembly of FIG. 13A to illustrate particular features thereof.
Figure 13E:
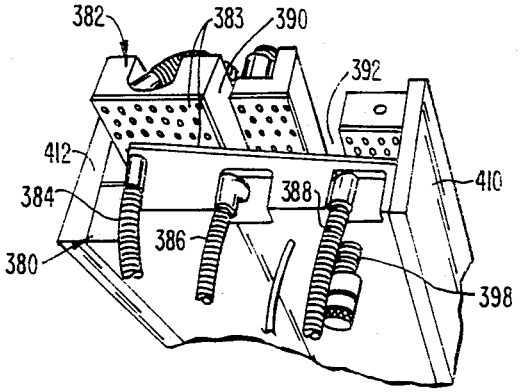
FIG. 13E is a top perspective view of radiant heat containment panels used with the heating platens.

With reference now to FIG. 13E, a further modification to the heating stations 34 through 42 is illustrated. The front platens 380 are provided with side radiant heat-containing panels 410 and 412 extending perpendicularly therefrom toward the rear platens 382. Although not shown in the drawing, a similar lower radiant heat-containment panel is attached to the bottom of the front platen 380 and extends outwardly from the front platens 380 toward the rear platens 382.

Note that the outwardly extending radiant heat-containment panels 410 and 412 surround and closely conform with the rear platen 382 when the front and rear platens 380 and 382 are engaged with a winding form 28. The radiant heat-containment panels 410 and 412 and the bottom heat-containment panel are in good heat-conducting relationship to the front platen 380 so as to receive heat generated by the resistance heaters embedded in the front platen 380 and to conduct that heat forwardly for radiation inwardly to the periphery of the wound coil on the winding forms 28. That radiation of heat to the periphery of the wound coils on winding forms 28 provides improved uniformity of heating of the coils, and particularly, the outside turns thereof. Thus, the radiated heat promotes uniform bonding throughout the wound coils on winding forms 28. The radiant heat-containment panels 410 and 412 are preferably finished in flat black to facilitate radiant heating.

In the overall operation of the heating units 34–42, the resistance heating of the first station 34 is established to provide a temperature of the platens 380 and 382 which is considerably in excess of the final desired temperature of the winding forms 28 and the coil bundle wound thereon. The excess temperature provides a rapid transfer of heat to the winding forms 28 and the coil bundle thereon to provide a high rate of increase in temperature of the winding form 28 and the coil bundle thereon. Overheating of the winding form 28 and the coil bundle thereon is prevented by virtue of the infrared temperature detector 404 which is continuously monitoring the temperature of the winding form 28. If a temperature in excess of the preset maximum is detected by the temperature sensor 404, the cylinder 396 is operated to open the platens 380 and 382 to terminate further conductive heating of the winding form 28. Each of the heating stations 34–40 are similarly provided with a temperature sensor 404 for the same purpose, and importantly, are independently controlled so that an excess temperature at any one of the heating stations 34–40 will cause that respective one of the heating stations to open to restrict further heating.

The final heating station 42 is also provided with an infrared temperature sensor 404 but is operated in a somewhat different fashion. Final station 42 is maintained at a lower temperature, near the desired coil bundle temperature, and controlled to remain closed until the desired set temperature is achieved, at which time, the platens 380 and 382 for the final heating station 42 are opened. This independent and different operation of the final heating station 42 assures that all coils achieve the desired bonding temperature prior to the completion of the heating operation. In other words, heating will continue at the final heating station 42 until the desired temperature is achieved, no matter how long that operation may take, and that operation is given precedence over the remaining operations for that purpose.

In the preferred operation of the heating stations 34–42, the excess temperature above the set temperature is greatest for the first heating station 34 and is progressively less for the subsequent heating stations 36, 38 and 40. Since each of those heating stations may operate above the predetermined maximum temperature, an over temperature protection utilizing the infrared temperature sensor 404 is provided. With respect to the final heating station 42, the temperature is maintained near the desired final temperature of the winding forms 28, and therefore, an over temperature condition is not possible. Consequently, the principal concern with respect to the final heating station 42 is the attainment of the set temperature, rather than the possible deleterious result of an over temperature.

In FIG. 13F, a perspective illustration is provided of the cooling subassembly 16 having cooling stations 44–52. The cooling stations 44–52 have a front platen 414 and a rear platen 416 mounted on moveable frame members 418 and 420 via compression springs 422 as described with respect to the heating stations 34–42. As also described with respect to the heating stations 34–42, each of the cooling stations 44–52 includes a cylinder 424 which operates the platens 414 and 416 via a floating bearing 426 for causing the platens 414 and 416 to self-adjust to the position of the winding form 28 when the cylinder 424 is actuated to bring the platens 414 and 416 into intimate heat conduction engagement with the winding forms 28.

Also similarly to the heating stations 34–42, the cooling stations 44–52 are provided with the elastomeric material 383 (see FIG. 13E) on the platens 414 and 416 which are heat conductive and provide for more intimate heat-conducting engagement between the platens 414 and 416 and the winding forms 28.

The cooling stations 44–52, rather than utilizing electrical resistance heating cartridges, contain a matrix of bored water passages for providing cooling by heat transfer from the winding forms 28 to the platens 414 and 416, and in turn to the water flowing through the internal water passages in the platens 414 and 416. The water passages are connected to a standard source of cooling water which may be reused through the means of a radiator or other heat transfer device for dissipating the thermal energy transferred from the winding forms 28 to the coolant water.

The last cooling station 52 includes an infrared temperature detector 428 which is mounted on the front platen 414 and detects the temperature of the winding form 28 through a suitable bore in the platen 414. The temperature sensor 428 provides a temperature signal to the programmable control which maintains the platens 414 and 416 of all of the cooling stations 44–52 in heat transfer engagement with the winding forms 28 until the temperature sensor 428 indicates that the temperature of the winding form 28 in the last cooling station 52 has declined to a predetermined set level. At that time, all of the cooling stations 44–52 are opened to terminate cooling of the winding forms.

The cooling stations 44–52 are mounted on a main frame 430 which may be raised and lowered by suitable lift cylinders 432, in a fashion previously described with respect to the heating stations 34–42. Thus, the cooling stations 44–52 are caused to assume an upper position for clamping, heat conducting engagement with the winding forms 28, and a lower position where the winding forms 28 are clear of the cooling stations 44–52 to permit indexing of the winding forms 28 to the right along upper track 31. Note that the rear platens 416 include a pair of slots 434 and 436 to permit the central element of the rear platen 416 to extend through the slot 181 in the support member 180 of the winding form 28 and thus allow maximum registration of the heat transfer surfaces of the rear platen 416 with the rear plate 170 of the winding form 28.

Figure 14:
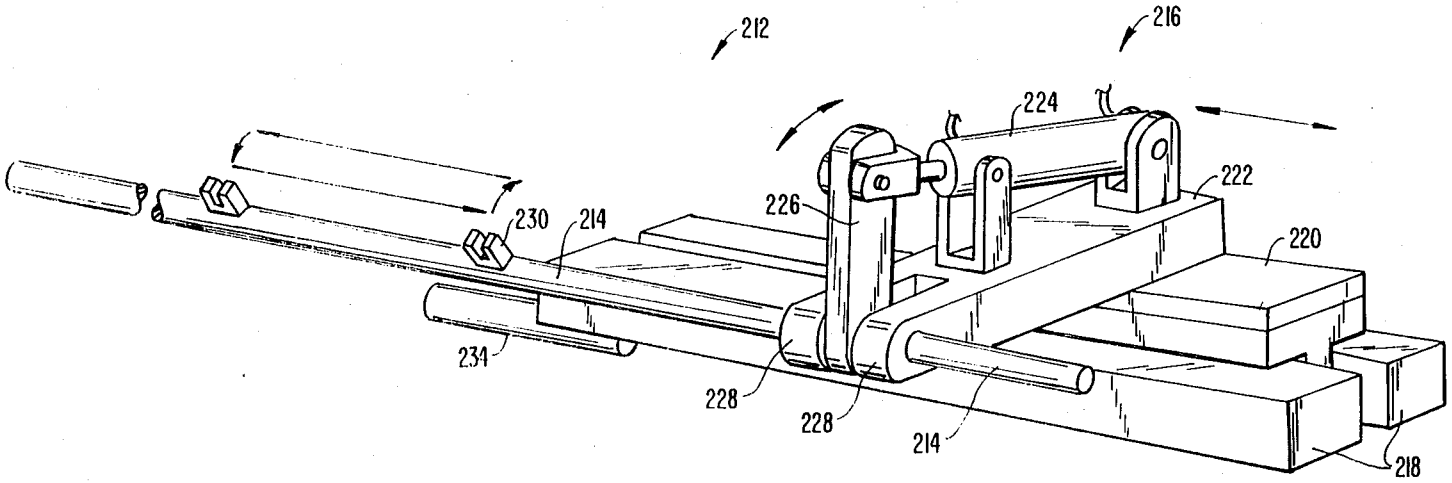
FIG. 14 is a simplified overall view of the upper transfer track indexing mechanism.

In FIG. 14, the mechanism 212 for indexing the pallets rightwardly one pallet at a time along the upper transfer track 1 is illustrated in simplified form. That mechanism (the left end of which is shown in FIG. 12) includes a pallet indexing rod 214 which extends substantially the full length of the upper pallet transfer track 31 and which is axially moveable by a pallet indexing rod operating mechanism 216. Mechanism 216 includes a pair of rodless operating cylinders 218, such as are made by Origa Corporation of Elmhurst, Illinois, which are pneumatically operated to index the pallet indexing rod 214 rightwardly and leftwardly one station, i.e., a distance somewhat greater than the width of a pallet 32. The rodless operating cylinders 218 carry an axially moveable platform 220 which includes a transverse arm 222 extending to the pallet indexing rod 214. The transverse arm 222 carries a pneumatically operated cylinder 224 connected to the end of a crank rod 226, which in turn is fixed to the pallet indexing rod 214 near one end. A pair of bearing blocks 228 are positioned on each side of the crank rod 226, trapping same, and thereby providing for left and rightward movement of the pallet indexing rod 214 along its axis with leftward and rightward movement of the platform 220 and transverse arm 222. Operation of the cylinder 224 causes rotation of the crank rod 226 to in turn rotate the pallet indexing rod 214. The rotation of the pallet indexing rod through operation of the cylinder 224 is approximately less than one-quarter turn and is sufficient to engage and to disengage a pair of axially-spaced indexing latch fingers 230 on rod 214 with an indexing latch boss (not shown) on the back side of each of the pallets 32. The fingers 230 are spaced so as to trap the boss on the pallets 32 between them.

In view of the above description, it will be appreciated that the pallet indexing rod operating mechanism functions to rotate the pallet indexing rod 214 downwardly to engage the indexing latch fingers 230 with the indexing latch bosses on pallets 32, to thereafter move rightwardly along the axis of pallet indexing rod 214 to index the pallets 32 and associated winding forms 28 rightwardly by the space of one station, to then rotate the pallet indexing rod 214 upwardly to disengage the indexing latch fingers 230 from the indexing latch bosses on the rear of pallets 32, to thereafter move the indexing rod 214 leftwardly along its axis by the distance of one station, and finally, to again rotate the pallet indexing rod 214 to move the indexing latch fingers downwardly to surrounding engagement with the indexing latch bosses 232 on pallets 32, locking all the pallets into position and preventing motion between pallets during the time winding is taking place.

Optionally, the pallet indexing rod operating mechanism 216 can be provided with a hydraulic damper 234 fixed to the frame of the machine 10 connected to the platform 220 to smooth the motions of the platform 220 under the control of the operating cylinders 218.

The vertical upward motion of the pallet 32 and winding form 28 along track 66 is coordinated with the operation of the indexing rod 214 in the following manner (see FIG. 12). The pallet 32 and winding form 28 is moved into the winding position 29 after the indexing rod 214 has completed its leftward travel and has been rotated into the locked position. At that time, the pallet 32 and winding form 28, moving upward with the lower edge of pallet 32 supported by the upper surface of the vertical up elevator 235, is guided into proper alignment in the winding position by the indexing latch 230 and is thus locked into the proper lateral position for winding.

Figure 15:
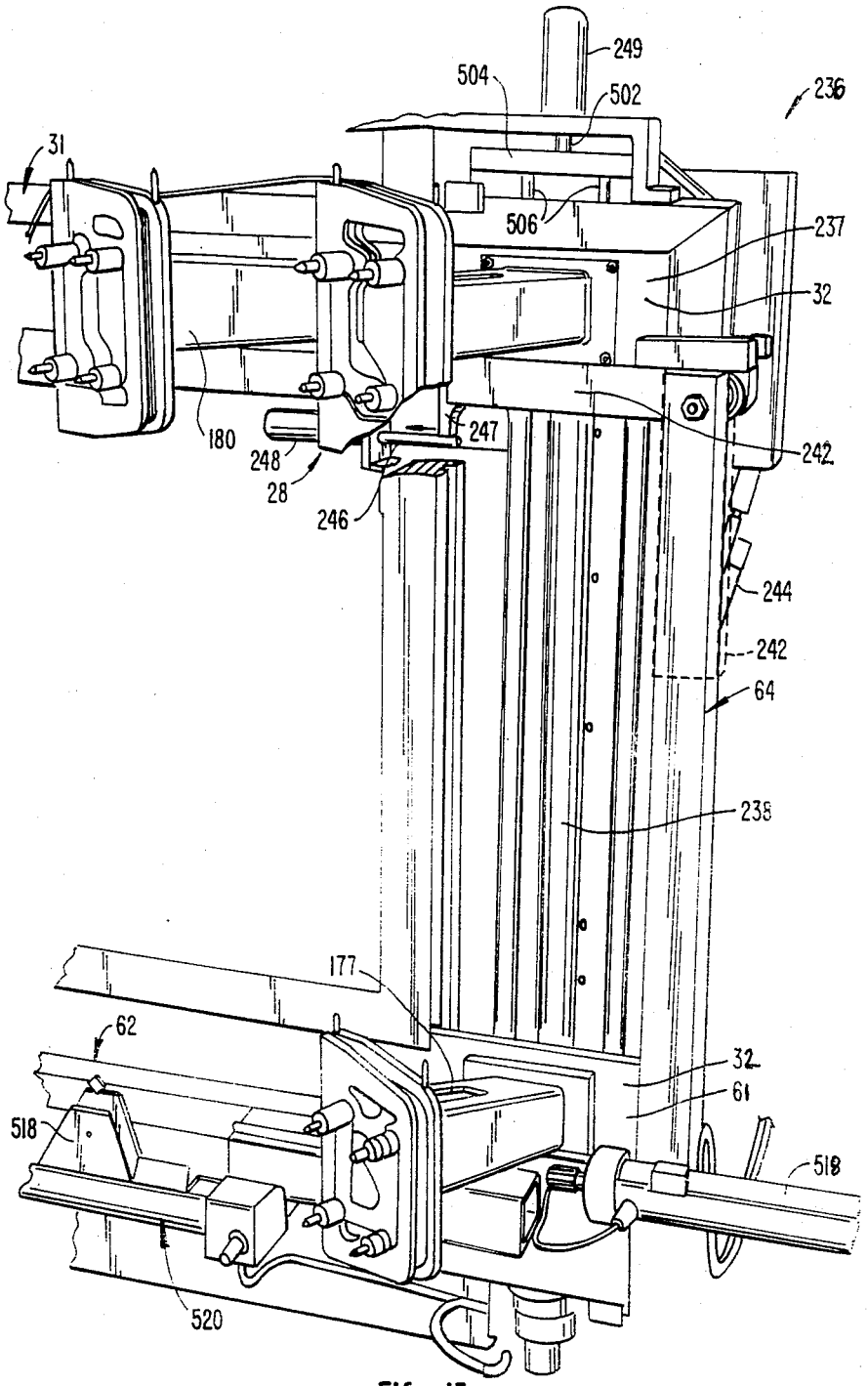
FIG. 15 is a perspective view of the downward transfer track of FIGS. 1 and 12B together with a downward transfer mechanism.

In FIG. 15, an enlarged illustration is provided of the downward transfer mechanism 236 which is associated with the downward transfer track 64 and which provides, at its upper end, the disassembly station 237 (see FIG. 12B) for winding forms 28. The downward transfer mechanism 236 includes a rodless cylinder 238 which drives an engaging collar up and down between stations 237 and 61 through a magnetic coupling with an internal piston (not shown) through the wall of the rodless cylinder 238. The piston of the rodless cylinder is pneumatically operated to move the collar 240 vertically along the rodless cylinder 238 for the purpose of lowering pallets 32 from the disassembly station 237 at the top of track 64 to lower reassembly station 61 at the bottom of track 64.

The downward transfer mechanism 236 includes a support gate 242 which is movable between a horizontal position as illustrated for supporting the pallet 32 in the disassembly position and downwardly to a vertical position (shown in dashed lines) for permitting and guiding the pallet 32 downwardly along the downward track 64. The support gate 242 is operated by a pneumatic cylinder 244 connected to the rightward end of the support gate 242 by a suitable crank and operating rod (not shown). A locking support pin 246 operated by a support pin cylinder 248 engages a bracket 247 on the leftward end of the support gate 242 to hold and support the support gate 242 in the horizontal position in the event of loss of air pressure to gate operating cylinder 244. The support pin 246 is retracted by the support pin cylinder 248 to permit the cylinder 244 to rotate the gate from the horizontal position to the vertical position.

As discussed above, winding form 28 is separated at disassembly station 237 so that only pallet 32, mounting arm 180, rear bracket 128 and rear plate 170 (but not the remainder of form 28) move downwardly along path 64 of system 30. The remainder of form 28, after removal of the completed pie-shaped coil, is reunited to the portion mounted to arm 180 at reassembly station 61 by subassembly 18, as discussed in detail below. Therefore, the form 28 shown at reassembly station 61 in FIG. 15 is after reassembly.

A vertical pusher cylinder 249 is provided to force the pallet 32, after separation from the front plate 168 and core 172, against the upper surface of the down elevator (not shown but similar to up elevator 235 of FIG. 12). Cylinder 249 includes main rod 502 which drives a horizontal bar 504 from which a pair of pallet engaging rods 506 depend. This effectively clamps pallet 32 between the down elevator and the lower ends of rods 506. Doing so helps to accurately locate the bottom edge of the pallet with respect to the track 64 for downward movement of the pallet 32. The vertical pusher cylinder 249 overcomes the tendency of the pallet 32 to tilt forwardly as a result of the weight of the mounting arm 180, rear bracket 178 and rear plate 170 which tends to prevent accurate alignment of the bottom edge of the pallet 32 with the track 64. Of course, other means can be provided to assure the alignment of pallet 32 and track 64.

After the winding form 28 is reassembled at the reassembly station 61, a supplemental cylinder 516 pushes the assembly of pallet 32, winding arm 180 and winding form 28 to the left in FIG. 15 about 30 to 40 cm. Doing so allows the pallet 32 to be engaged by the saddle 518 of a rodless cylinder 520. The rodless cylinder 520 extends the length of the lower transfer track 62. The saddle 518 of the rodless cylinder 520 moves the winding form 28 to the left to the wait station at the leftmost end of the track 62 with other empty winding forms 28 and then returns to pick up the next reassembled, empty winding form 28.

Figure 16A:
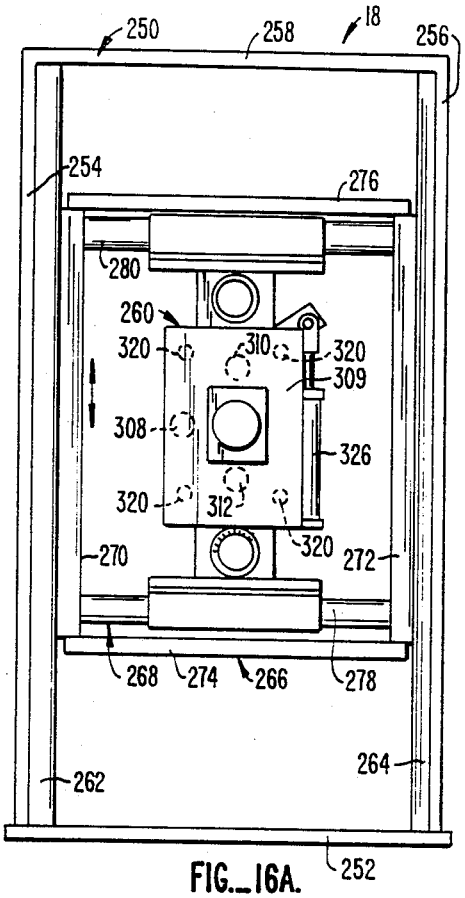
FIGS. 16A and 16B are somewhat simplified front and rear elevational views of the winding form manipulator subassembly of FIG. 1.
Figure 16B:
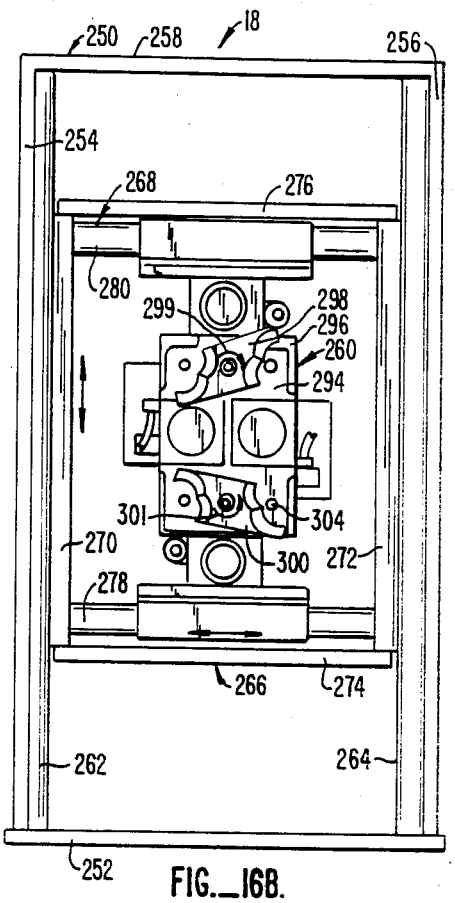

With reference now to FIGS. 16A and 16B, front and rear views of the winding form manipulator subassembly 18 are illustrated in a simplified form. The winding form manipulator subassembly 18 includes a frame 250 having a base 252, a pair of side frame members 254 and 256, and an upper brace 258 connecting across the side frame members 254 and 256. Within the frame 250, the winding form manipulator head 260 is mounted for upward and downward excursions and leftward and rightward excursions. To facilitate such excursions of the winding form manipulator head 260, the winding form manipulator subassembly 18 is provided with a pair of vertical guide columns 262 and 264 that extend from the base 252 to the upper brace 258. A carriage 266 is slidably mounted on the vertical guide columns 262 and 264. The carriage 266, in turn, includes a movable frame 268 comprising two vertical side members 270 and 272, a bottom member 274 and a top member 276. The movable carriage 266 includes a pair of horizontal guide columns 278 and 280 extending between the vertical side members 270 and 272. The winding form manipulator head 260 is slidably mounted on the horizontal guide columns 278 and 280 for leftward and rightward movement.

In view of the above, it will be appreciated that the winding form manipulator head 260 is movable upwardly and downwardly since it is carried by the movable frame 268 along the vertical guide columns 262 and 264. Additionally, the winding form manipulator head 260 is carried within the movable frame 268 for leftward and rightward movements along the horizontal guide columns 278 and 280. Vertical movement of the movable frame 268 and the winding form manipulator head 260 is provided by a pair of rodless cylinders which extend in parallel with the vertical guide columns 262 and 264, each of which has a follower which is attached to the movable frame 268 by a suitable bracket.

The winding form manipulator head 260 is moved leftwardly and rightwardly by a horizontal rodless cylinder which has its follower attached by a suitable bracket to the winding form manipulator head 260. In the preferred embodiment, the horizontal rodless cylinder is mounted on the top member 276 of the movable frame 268.

As an overview of the operation of the winding form manipulator subassembly 18, the winding form manipulator head 266 is first positioned in its upper, leftward station (relative to FIGS. 1 and 16A) to be aligned with the rightward most winding form 28 along upper track 31 (i.e., the winding form 28 positioned at disassembly station 237, see FIG. 12B). At station 237, the winding form manipulator head 260 removes the front plate 168 and the core 172, leaving the rear plate 170 attached to the pallet 32. The coil bundle remains on the core 172 and is thus carried by the winding form manipulator head 260. After the pallet 32 and rear plate 170 are moved vertically downward by the down elevator mechanism 236 to position 61, the winding form manipulator head 260 then moves rightwardly, in conjunction with the next index cycle, remaining at its upper level, so as to be aligned with the leftward most storage arbor 54 at an unload station 293 (see FIG. 12B). At unload station 293, the winding form manipulator head 260 ejects the completed coil onto the storage arbor 54. Thereafter, the winding form manipulator head 260 first moves downwardly and then leftwardly to its lower, leftward-most position, reassembly station 61. In this third and final station, the winding form manipulator head 260 rejoins the front plate 168 and its core 172 to the rear plate 170 and attached pallet 32. Thereafter, the reassembled winding form 28 then moves leftwardly along the lower transfer track 62.

Figure 17:
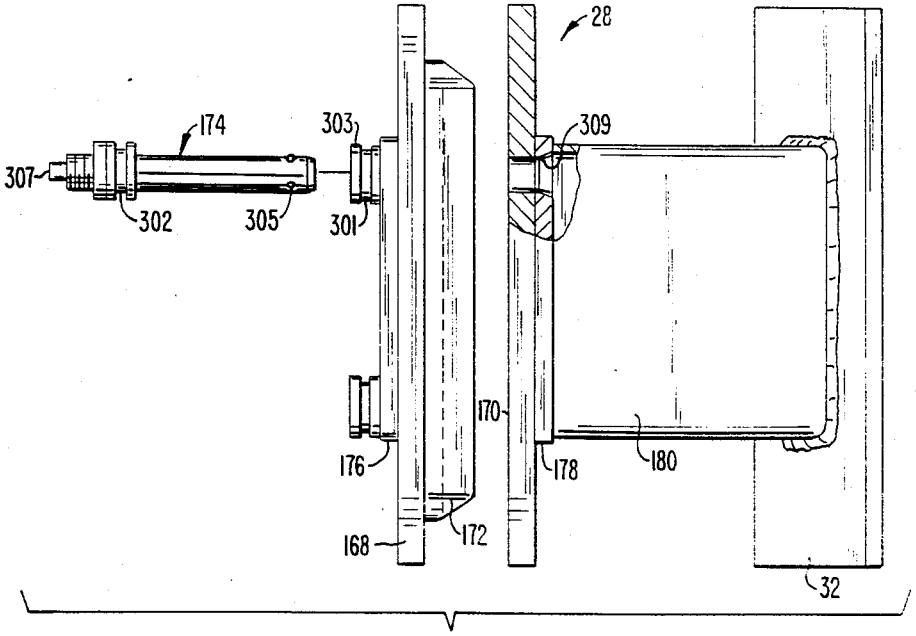
FIG. 17 is a simplified exploded elevational view of the form of FIG. 10.
Figure 13G:
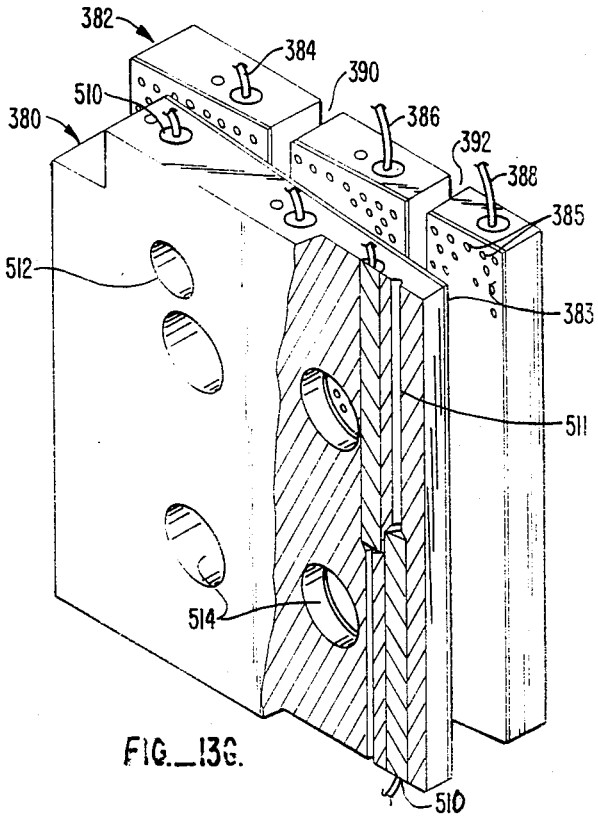
FIG. 13G is a simplified isometric view of the heating platens of FIG. 13D with a portion broken away for clarity.

The manner in which the winding form 28 is first disassembled and then reassembled can best be appreciated after the components of the winding form 28 are considered in some detail. Referring now to FIG. 17, the basic operational construction of form 28, mounting arm 180 and pallet 32 is illustrated as being of three main groups. The first is the combination of pallet 32, mounting arm 180, rear bracket 178 and rear plate 170; the second is a combination of core 172, front plate 168, plunger bracket 176 and four collars 303 fixed to plunger bracket 176; the third is rods 174.

Although the disassembly and reassembly of the winding forms 28 is accomplished automatically by the manipulator head 260, the operation thereof might be better perceived if manual disassembly and reassembly of the winding forms 28 is visualized. To assemble manually, one inserts each rod 174 through common bores in collar 303, plunger bracket 176 and core 172. Rear plate 170 is then placed so mating holes fit over the protruding ends of rods 174. The radially-biased balls 305 at the ends of rods 174 engage a chamfered well 309 in rear bracket 178 to secure the forms 28 in place. To disassemble manually, one would grasp the groove 302 in rod 174 between two fingers, push on button 307 (which allows balls 305 to retract) with the thumb and pull on rod 174 with the two fingers while at the same time restraining collar 303 at groove 301 with the other hand to permit rod 174 to be pulled free. Head 260 accomplishes basically the same thing but does so by manipulating all four rods 174 at once.

Figure 18:
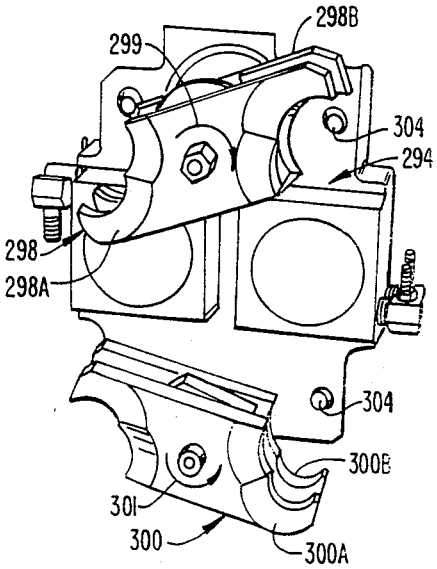
FIG. 18 is a perspective view of a part of the winding form manipulator head of FIG. 16B.

With reference to FIGS. 16B and 18, a more detailed view of the forward portion of the winding form manipulator head 260 is provided. As can be seen in the figures, the winding form manipulator head 260 includes a central core member 294 and a surrounding ejector plate 296. Both the central core member 294 and the surrounding ejector plate 296 are independently movable, and at various times move relative to each other. The central core member 294 carries an upper rotable pin grip 298 and a lower rotable pin grip 300. The upper rotable pin grip 298 and the lower rotable pin grip 300 comprise a pair of independently axially movable s-form gripping plates 298A, 298B, 300A and 300B, respectively, for engaging and securing grooves 301, 302 (see FIGS. 10 and 17) on collars 303 and plunger/ball release rods 174, respectively. Notice that each of the gripping plates 298A, 298B, 300A and 300B partially surround and engages plunger/ball release rods 174 by engaging with and residing in circumferential grooves 301, 302 upon rotation of the gripping plates 298A, 298B, 300A and 300B. The gripping plates 298A, 298B, 300A and 300B are linked together for simultaneous rotation, with gripping plates 298A and B rotating in the opposite direction from gripping plates 300A and B, as indicated by the arrows 299, 301 in FIGS. 16B and 18. As discussed above, it is necessary to hold collar 303 in place while depressing buttons 307 and partially withdrawing rods 174. This is accomplished by the bifurcated rotable pin grips 298 and 300. Each of the independently axially movable s-shaped plate members 298A, 298B, 300A and 300B have arcuate cutouts at each end for the purposes described. The two plates are relatively movable along their axis of rotation after the arcuate ends thereof have rotated in the direction of the arrows 299 and 301 of FIG. 16B to engage the respective grooves 301, 302 on the collar 303 and the plunger/ball release rod 174. Through this independent axial movement, the button 307 is depressed by the movement of pins 304 to release the plunger/ball release rods 174 from the rear bracket 178. The plunger/ball release rod 174 can then be partially retracted from the front plate assembly 168 by axial movement of the front s-shaped member 298A and 300A relative to the rear s-shaped members 298B and 300B. This enables the plunger/ball release rods 174 to be extracted from the rear bracket and the rear plate assembly 170 entirely while still holding and controlling the position of the front plate assembly 168. Independent motion of the front s-shaped members 298A and 300A relative to the rear s-shaped members 298B and 300B is accomplished by suitable air cylinders (not shown).

In summary, the overall movement and operation of the s-shaped rotable pin grip members 298 and 300 is as follows: The members 298A, 298B, 300A and 300B move forward in unison to align the arcuate cutouts in the ends thereof with the grooves 301, 302. Thereafter, the s-shaped rotable pin grip members 298 and 300 rotate in unison but in opposite directions to engage those collars. Thereafter, button 307 is depressed to release the balls 305 from their grip with the rear bracket 178. Whereupon, the front s-shaped rotable pin grips 298A and 300A remain in position while the rear s-shaped rotable pin grips 298B and 300B move backward to partially retract the plunger/ball release rods 174. The plunger/ball release rods 174 are retracted sufficiently so that the rods clear the rear plate assembly 170.

Figure 16C:
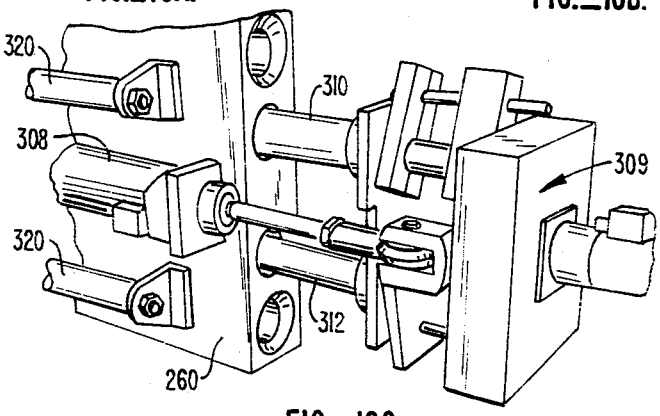
FIG. 16C is a front perspective view of a portion of the winding form manipulator head of 16A with the connector plate extended.

The s-shaped collar grips 298 and 300 are retracted by means of an air cylinder 308, see FIGS. 16A and 16C, mounted on the left side of the winding form manipulator head 260. The air cylinder 308 in turn moves a connecting plate 309 which is connected to a pair of rods 310 and 312. The rods 310 and 312 extend through the winding form manipulator head 260 and carry the s-shaped collar grips 298 and 300. The rods 310 and 312 are rotated by a vertically mounted air cylinder 314 which is connected to the rods 310 and 312 through a suitable crank arm arrangement to rotate rods 310 and 312 in opposite directions but of like amount. From the foregoing, it will be appreciated that the s-shaped collar grips 298 and 300 are mounted for rotational movement in opposite directions to engage the grooves 302, 301 of the plunger/ball release rods 174 and are additionally mounted for rearward movement to retract the plunger/ball release rods 174. The front plate 168, the collars 303, plunger bracket 176 and core 172 are securely held by collar grips 298B and 300B

Figure 19:
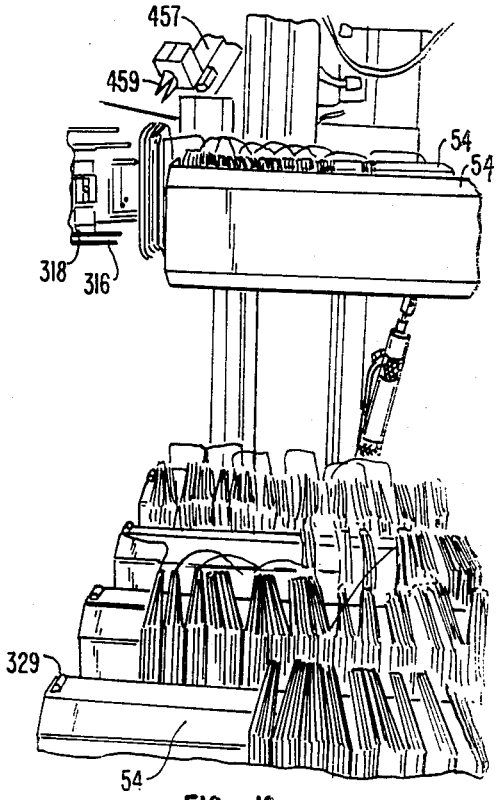
FIG. 19 is a perspective view showing the manipulator head of FIG. 16B holding a winding form after the rear plate has been removed and positioned at the unloading station of FIG. 13 just prior to the ejection of the coil onto the storage arbor.
Figure 20:
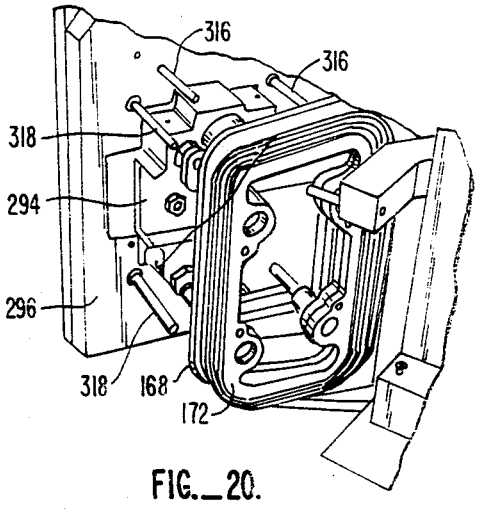
FIG. 20 shows the front plate and core of the winding form of FIG. 17 removed from the rear plate.
Figure 22:
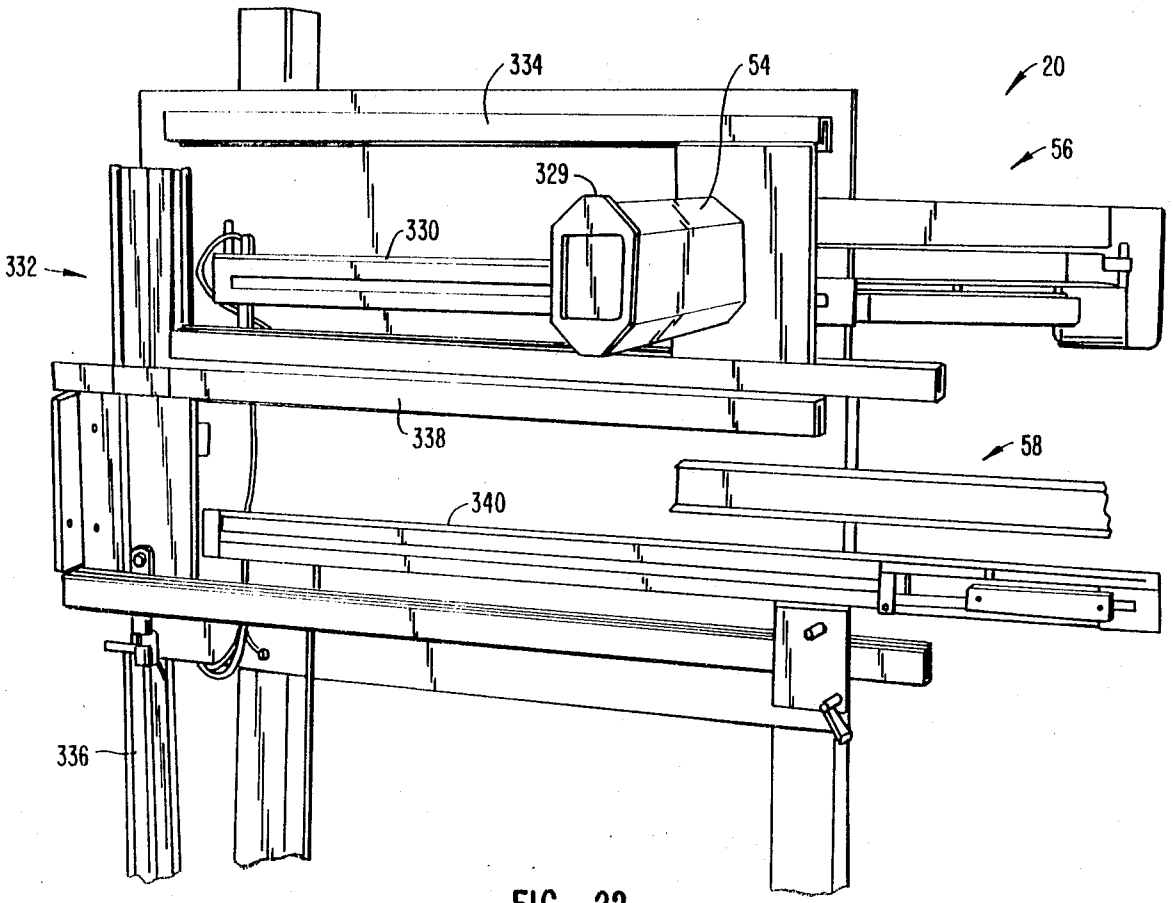

Referring now also to FIGS. 19 and 20, manipulator head 260 is seen to have moved from disassembly station 237 to unloading station 293 opposite the left-most arbor 54 on upper track 334 (see FIG. 22). Note that rear plate 170, rear bracket 178, arm 180 and pallet 32 has been separate from the remainder of winding form 28, and is thereafter lowered to reassembly station 61 by the downward transfer mechanism 236.

Figure 21:
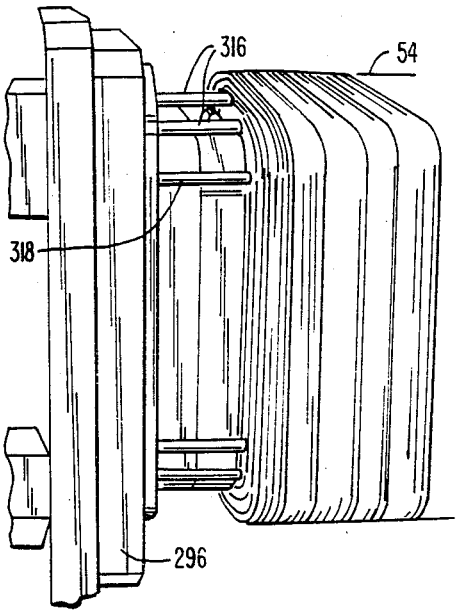
FIG. 21 shows the ejection pins of FIG. 20 pushing the completed coil onto an arbor.

The surrounding ejector plate 296 of the manipulator head 260 carries eight ejector pins, the four shorter pins 316 being fixedly mounted to the surrounding ejector plate 296 and the four longer pins 318 (about 2.5 cm longer) being resiliently mounted through compression springs which allow retraction of the longer front pins against the bias of the springs to the height of the shorter pins. The surrounding ejector plate 296 is movable forwardly by four air cylinders 320, two being mounted on each side of the winding form manipulator head 260. The fixed ejector pins 316 and the spring-loaded ejector pins 318 pass through corresponding openings 322 and 324 (see FIG. 10) in the front plate 168 of the winding forms 28 to engage the forward face of the completed coil when the ejector pin plate 296 is moved forwardly by the air cylinders 320 to push the completed coil off of the core 172 of the winding form 28 and onto the storage arbor 54 as shown in FIG. 21.

Since the completed coils are tightly wound on the core 172, there is considerable friction tending to hold the completed coil on the core 172 which must be overcome by the force exerted by the ejector pins 316 and 318. Once that friction is overcome, and the completed coil is then freely movable onto the storage arbor 54, the spring-loaded ejector pins 318 extend outwardly beyond the fixed ejector pins 316 under the influence of the springs to give the completed coil an additional push onto the storage arbor 54. (See FIG. 21.) Note that unloading of the completed coil from core 172 occurs at the unloading station 293. The additional push onto the storage arbor 54 provided by the spring-biased ejector pins 318 assures that the completed coils are retained on the arbor 54 in a sufficiently rearward position so as to prevent the coils from dropping off of the storage arbor 54 when they are no longer restrained by the winding form 28. It should also be noted that the storage arbors 54 have a small cylindrical projection 329, shown in FIG. 19, on its upward forward surface to aid in retaining the completed coils on the storage arbors 54. Without such a projection the completed coils may tend to fall off the end of arbors 54.

Note that when the wire bundles are placed on the storage arbor 54, see FIG. 19, and thereafter are assembled as a part of a toroidal winding, the inner connecting lead extends from the juxtaposed side of the inside leg of one bundle to the juxtaposed side of the outside leg of the next bundle. This causes the lead to extend from the inside to the outside of the coil bundle to accommodate the length of the interconnecting lead without need for excessive folding or loose wire, and at the same time avoids any engagement of the interconnecting wire with turns of the bundle with a high voltage differential.

The central core member 294 and its s-shaped collar grips 298 and 300 must be moved rearwardly to provide adequate clearance for transit between the three stations 237, 293 and 61, and then forwardly to be in position to accomplish the operations described above. This is accomplished with a side-mounted cylinder 326 (see FIG. 16A) which moves a main mounting plate which in turn carries both the release pin air cylinder 308 and the air cylinder 314 for rotating the s-shaped members 298 and 300.

Reassembly of the front flange 168 and the core 172 to the rear flange 170 and pallet 32 of the winding form 28 occurs as follows. With the central core member 294 and s-shaped collar grips 298 and 300 of the winding form manipulator subassembly 18 in the retracted position, the winding form manipulator head 260 is moved first downwardly (to clear the next sequential winding form 28 located in the disassembly station 237) and then leftwardly to align the winding form manipulator head 260 with the reassembly station 61 at the bottom of the downward track 64 (see FIGS. 12B and 22A). Of course, during this movement, the s-shaped collar grips 298 and 300 are in their rotated gripping position and retain the front flange member 168 and core member 172 of the disassembled winding form 28. Moreover, the s-shaped collar grips 298 and 300 are in their retracted position so as to maintain the buttons 307 depressed to retract the radially-biased balls 305 at the ends of the plunger/ball release rods 174. With the plunger/ball release rods 174 aligned with the corresponding bores in the rear plate 170, the plunger/ball release rods 174 are first extended forwardly by moving rear s-shaped plates 298B and 300B forward. This initial extension of the plunger/ball release rods 174 facilitates alignment of the conical ends of the release rods 174 with the corresponding bores in the rear plate 170 of the disassembled winding form 28. Hereafter, the entire head 260 moves forward under the control of an air cylinder to fully insert the plunger/ball release rods 174 in the corresponding bores in the rear plate 170. To thereafter lock the plunger/ball release rods 174 in place, the s-shaped gripping members 298 and 300 are rotated in the direction opposite the arrows 299 and 301 of FIG. 16B to release the collars of the release rods 174 and the front plate 168. Thereafter, the winding form manipulator head 260 is retracted to release the buttons 307 thereby allowing the balls 305 to lock in their radially-extended positions. To facilitate locking of the release rods 174 with the balls 305 in their radially-outward position, the length of the release rods 174 from the collar to the balls 305 at the ends of rods 174 has an approximately 0.25 mm inch additional length with respect to the corresponding assembled dimension of the front plate 168, core 172 and rear plate 170 to provide that approximately 0.25 mm tolerance. Without an adequate tolerance, efficient clearance may not be provided to allow the balls 305 to bias radially-outwardly to their locked position to lock together the front plate 168 and the rear plate 170 of the winding form 28.

After reassembly of the winding form 28 at the reassembly position 61, the retracted winding form manipulator head 260 moves upwardly to position itself in alignment with the winding form 28 located at the disassembly station 237. Thereupon, the winding form manipulator head 260 extends forwardly, releases the plunger/ball release rods 174 as previously described, and retracts to remove the front plate 168 and core 172 (carrying the next coil bundle) of the winding form 28 at the disassembly station 237. At that point, the winding form manipulator head 260 pauses until the current winding, heating and cooling operations are completed. Specifically, the winding form manipulator head 260 pauses until the bundle then being wound at the winding station 29 is completed, the bundle then in the last heating station 42 has reached its desired set temperature and the bundle in the last cooling station 52 has cooled to its desired set temperature. When all three conditions are met (e.g., AND function), the controller initiates the next indexing of the winding forms 28 along with the movement of the winding form manipulator head 260 rightwardly to align the disassembled front plate 168 and core 172 with the storage mandrel 54 at the unloading station 293.

In FIG. 22, an overview of the coil storage subassembly 20 is illustrated. The coil storage subassembly 2 carries up to ten storage arbors 54 in the top and bottom rails 56, 58, up to five in each rail. Only one storage arbor 54 is shown in FIG. 22 for clarity. Empty storage arbors 54 are loaded at the rightward end of the top rail 56 and are moved leftwardly under the control of a rodless cylinder 330 to a vertical elevator 332. An appropriate proximity switch is included to sense the presence of a new storage mandrel 54 in the leftward most position on the upper track 334 of the coil storage subassembly 20. Upon completion of a pre-programmed number of coil bundles, e.g., 20, the machine control lowers the now-full storage mandrel 54 under the control of a suitable vertical cylinder 336 until it is aligned with the lower track 338. A lower track rodless cylinder 340 is adapted to move the full storage arbors 54 rightwardly along the lower rail 58. Full storage arbors 54 are then removable from the rightward end of the lower rail 58.

Figure 23:
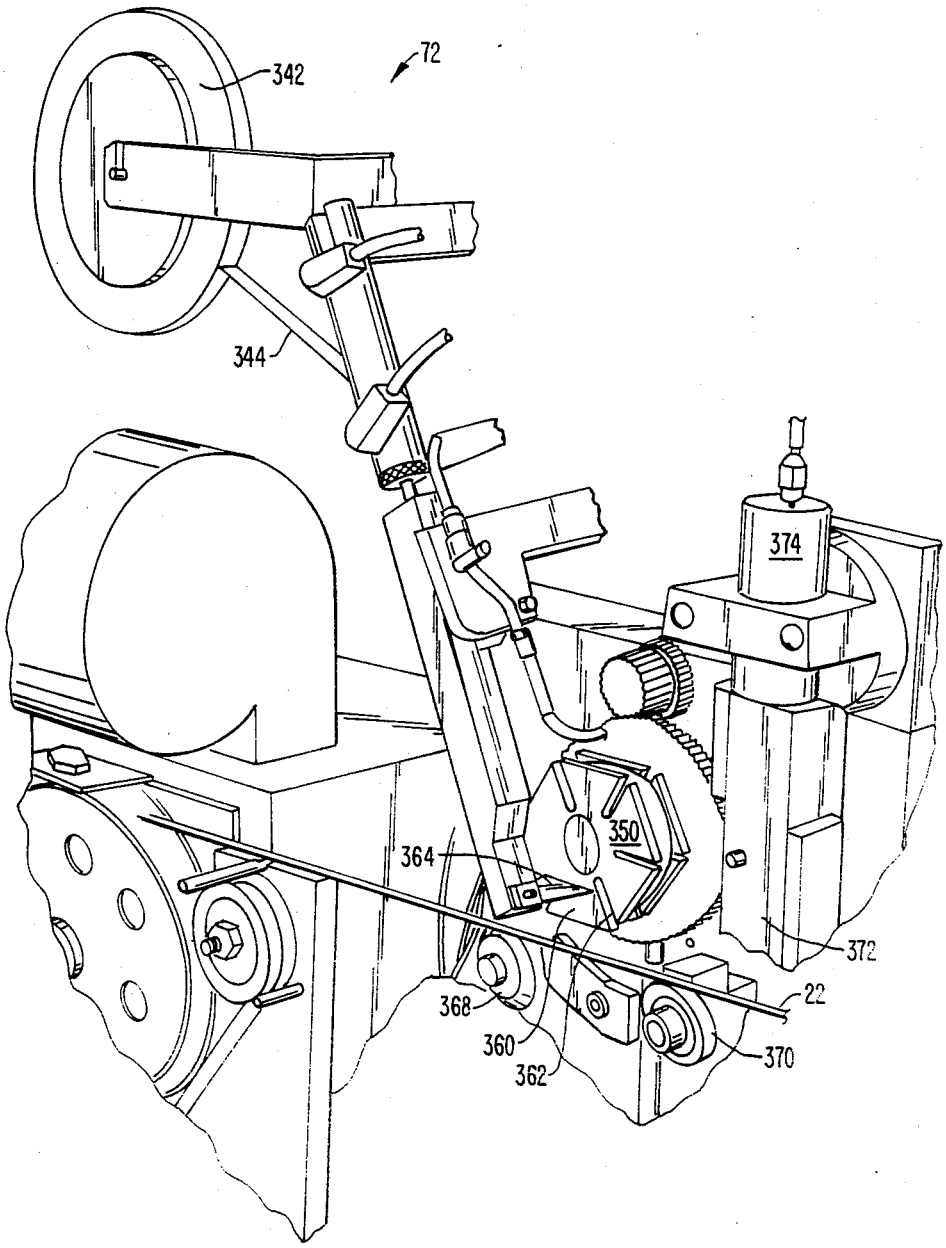
FIG. 23 is an enlarged view of the tape applier of FIG. 2.
Figure 24:
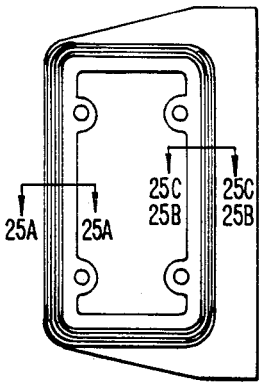
FIG. 24 is a simplified side cross-sectional view of a form with a coil wound thereon.

In FIG. 23, a more detailed view is provided of the optional tape applier 72. Tape 344 is used along those sections of wire 22 at which extra insulation improves the dielectric strength of sections of wire 22 which experience high electrical stress. The tape applier 72 surrounds the wire 22 with a short section of insulating tape at the location where in the wire traverses from the innermost turn across all of the turns to egress from the coil to the next adjacent coil. Since it crosses all of the turns, that short length of wire, for convenience termed a "diver" wire, experiences the highest electrical stress. Thus, the short length of tape increases the dielectric strength as between the "diver" wire and the turns which it passes to provide greater breakdown characteristics of the toroidal transformer.

The tape applier 72, shown also in less detail in FIG. 2, is seen to include a reel 342 of tape formed from high-dielectric plastic material which is adhesively coated on one side. The tape from reel 342 passes over a first guide pulley 346 (see FIG. 2) and then a second guide pulley 348. Thereafter, the tape passes around five sides of a six-sided, rotatable arbor member 350 with the adhesive surface facing outwardly. The six-sided arbor member 350 has a peripheral groove provided with radial air passages to a plenum at the core of the six-sided arbor member 350. A vacuum is applied to these air passages to hold the tape in place on the six-sided arbor member with the sticky side of tape 344 facing outwardly.

A knife 364 is pivotally mounted for entering the downwardly facing slot 362 on the rightward side of the lower horizontal section of the arbor member 360. Thus, when moved across a cam surface by a suitable air cylinder, the knife 364 slices a section of tape away from the source 342 to leave a short separated section on the lower horizontal side of the arbor member 360. That short section is applied to the wire 22 which is supported between two support pulleys 368 and 370.

To apply the short section of cut tape to the wire 22, the arbor member 360 is moved downwardly under the control of an air cylinder (not shown) to engage the "diver" section of wire 22 with the sticky surface of tape 344, whereupon vacuum to that portion of the six-sided arbor is released so that the tape remains adhered to the wire as the arbor moves upward away from the wire. After the short section of tape 344 is applied to the wire 22, the arbor member 360 moves upward and then leftwardly under the control of another cylinder (not shown). That same motion of the arbor member 360 brings a tape gripper 372 (not shown in FIG. 2) into registration with the section of tape applied to the "diver" section of the wire 22 between support pulleys 368 and 370. The gripper 372 has a pair of elastomeric surfaces which can be brought together under control of an air cylinder 374 to wrap the tape around the wire 22. Since the width of the tape exceeds the circumference of the wire 22, a short tape flange is formed when the sticky surfaces adhere which extends downwardly below the wire 22. The proper application of the tape to the wire 22 may be sensed by sensing the presence of this flange, for example, by a suitable photo-optic detector (not shown).

The cycle of applying, cutting, and gripping the tape is repeated for each coil bundle which is wound. Note that the six-sided arbor rotates one-sixth of a turn after a section of tape is applied to bring a new section of tape into registration with the wire for each new coil bundle.

Figure 26:
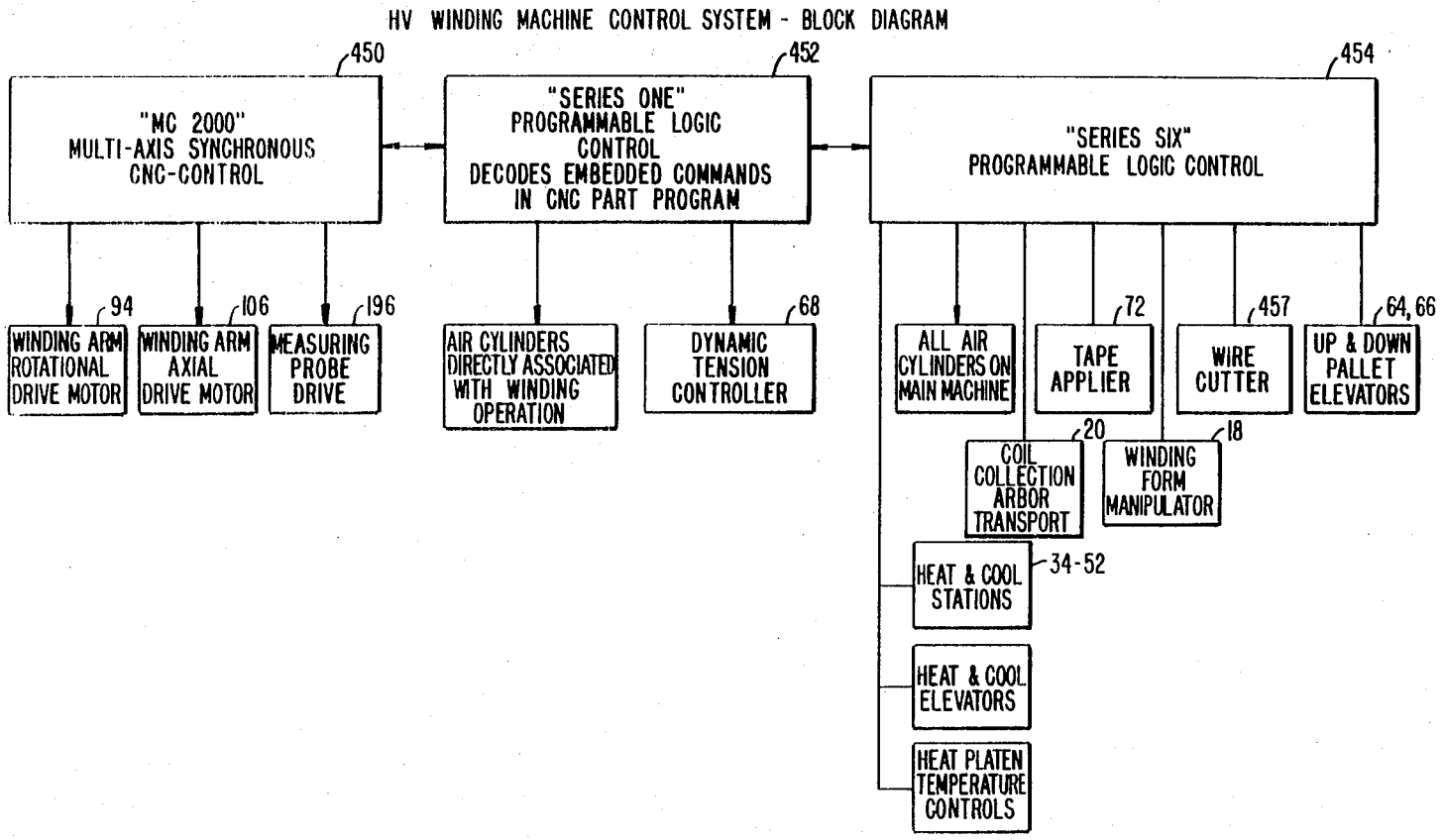
FIG. 26 is a block diagram of the control system for the coil winding machine of FIG. 1.

The overall control system for the high voltage winding machine 10, illustrated schematically in FIG. 26, uses three logically interconnected programmable controls, a first programmable controller 450 which preferably is a General Electric MC 2000 multi-axis synchronous CNC (computer numerical control) control, a second programmable controller 452 which is preferably a General Electric "Series One" programmable logic control, and a third programmable controller 454 which is a General Electric "Series Six" programmable logic control. The controller 450 is a three-axis controller which normally operates under the control of a "part" program identified as F1-610-1.PRO. Such a controller has general application to machine tool control. The controller 450 is principally used to control the winding arm rotational drive motor 94 which rotates the winding arm 26 through the tooth belt drive 98. The first controller 450 also controls the motor rotating the drive screw 106 which moves the drive nut 112 leftwardly and rightwardly along the axis of rotation of the winding arm 26 in a predetermined relationship with the rotation of the winding arm rotational drive motor 94 to move the winding guide wheel 136 in a fashion to control the placement of the wire 22 within the cavity of the winding form 28. The first controller 450 also controls the winding form measuring unit 196 by controlling its ball screw slide. Since the first controller 450 is a synchronous controller, the winding arm rotational drive motor 94 and the winding arm axial drive motor can be operated in a programmed relationship. While the measuring probe could also be operated synchronously, it is not necessary in this application. The first controller 450 also provides closed loop control through suitable feedback transducers. The second programmable controller 452 is coupled to the first controller 450 and receives 4-bit BCD embedded commands in the "part" program resident in the first controller 450 and interprets those embedded commands to provide output signals both to the third programmable controller 454 and the devices operated directly by the second programmable controller 452. In this particular application, those devices include the various air cylinders which control winding operation and the dynamic tension controller 68. It should be noted that the second programmable controller 452 is optional and is used conveniently in this application to interpret the embedded commands of the part program in the first controller 450 in lieu of using additional I/O devices in the third programmable controller 454.

The third programmable controller 454 operates essentially as an overall controller for the high voltage winding machine 10. The third controller 454 provides enabling commands to the first controller 450 which initiate the various winding functions. As the various winding functions are carried out by the first controller 450, the embedded commands are encountered and generated which in turn enable further functions directed by the third controller 454 such as the operation of the tape applier, the operation of the wire cutter and the various heating and cooling operations. The controllers 450, 452 and 454 are commercially available and supplied with extensive information with respect to the controller functions analogous to those described herein. For the sake of brevity, that information is not provided herein.

By the use of flexible programmable controllers 450, 452 and 454, the requirement for cams, linkages and other synchronizing and operating elements are largely eliminated. In their stead, relatively simple solenoid operated air cylinders are used which respond to signals from the programmable controllers 450, 452 and 454.

Through the use of such controllers, not only can the position of the wire within the wire cavities be controlled by computer, computer control is used for indexing the winding forms 28 only upon certain task completions as indicated by signals provided to the controllers 450–454. As previously indicated, the transfer line for the winding forms 28 is not operated to unload the next completed coil until the first controller 450 indicates that the winding of the current coil has been completed and the third controller 454 indicates that the coil bundle in the last heating station 42 has reached the desired elevated temperature and that the coil bundle in the last cooling station 52 has cooled to the desired low temperature. Therefore, the transfers of the coil bundles are task-dependent based on signals indicating completion of a task rather than time-dependent. Moreover, such programmable control facilitates the manufacture of windings from a number of coil bundles whereby the coil bundles can be counted prior to severing of the wire 22 and differing numbers of turns can be placed on different coil bundles within the same winding section to adjust the turns ratio of the transformer in which the winding section is used. Furthermore, different transformer designs can be accommodated merely by changing the "part" program within the first programmable controller 450. The second programmable controller 452 and the third programmable controller 454 may remain programmed as is, and are fully adapted for the new design by their response to the first programmable controller 450.

Enhanced efficiency of the toroidal winding manufactured by the winding machine 10 is obtained through careful placing of turns in the pie-shaped coil bundles. Turns are placed at particular positions in the coil bundles during the winding cycle by axial movements of the winding arm 26 through rotation of shaft 106 under the control of the programmable controller 450 which, operating with controllers 452 and 454, simultaneously controls the operations of all of the drive and positioning motors, as well as the various air cylinders.

A number of overall factors apply to turn placement. Particularly, the placement of the conductors in the pie-shaped coil bundles is arranged to achieve the best practical space factor. This, in turn, is achieved by assuring that all conductors lie in parallel at both the radially-inside leg and the radially-outside leg of the bundle and that all crossovers of the conductors (e.g., to transition the wire from one position in the bundle for one turn to another position in the bundle for the next turn) occur at the diverging yoke. In particular, in the preferred embodiment, the diverging yoke is at the top of the coil, and therefore, all transitions from one turn to the next turn occur at the top of the coil. As an additional guiding principle, no two adjacent conductors have a voltage between them which represents more than the voltage induced in 50% of the turns of a pie-shaped coil bundle. This provision assures that the dielectric strength of the insulation coating on the conductors will not be exceeded even during electrically stressful transient conditions of the transformer. This consideration becomes most critical with respect to the radially-outside leg of the pie-shaped coil bundle. Particularly, as compared to the radially-inside leg of the coil, the radially-outside leg has the potential for greater electrical stress between turns. In this regard, the radially-inside leg has a deeper build because of the limited circumferential width of the tapered inside coil portion to thereby inherently separate conductors of remote turns. The radially-outside leg, on the other hand, entails considerably greater circumferential width, and therefore, creates the circumstances under which electrically remote turns may be positioned in close proximity. It will be appreciated that the term "electrically remote turns" refers to turns which are numerically spaced in the winding cycle of an individual pie-shaped coil bundle, and therefore, have a significant voltage differential between those conductors which is proportional to the difference in the turn numbers between them.

The coils may be wound under the control of the programmable controller 450 generally in the manner and pattern disclosed in the above-mentioned U.S. Pat. No. 4,699,184, issued Oct. 13, 1987 to MACEMON et al. Said U.S. Patent teaches the manner in which a winding guide, such as winding wheel 136, may be used to accurately position turns within a pie-shaped cavity. While said U.S. Patent discloses a nonrotatable guide and a rotatable cavity, the same teachings apply to a rotatable guide and a nonrotatable cavity as disclosed herein. That procedure will not be repeated.

Figure 25A:
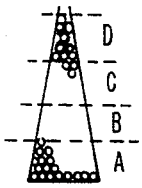
FIGS. 25A, 25B and 25C are schematic representations taken along lines 25A—25A, 25B—25B and 25C—25C of FIG. 24 illustrating three different winding patterns.

An alternative pattern to that disclosed in said U.S. Patent is seen in FIGS. 24, 25A, 25B and 25C. This alternative pattern assures that the remote turns are placed in spaced positions within the coil bundles. With reference now to the radially-inside leg of the cross section illustrated in FIG. 25A, it can be seen that the restricted circumferential width of the radially-inside leg tends to stack the turns radially such that the lowest numerical turns are nearest the core of the winding and the highest numerical turns are nearest the apex of the pie-shaped coil. Illustrative of this, FIG. 25A is marked with indications labels A–D of the groupings of the turns from the first 25 percentile (A) of the numerical order of the turns through the last 25 percentile (D) of the numerical order of the turns, the former being near the core nd the latter being near the apex.

Figure 25B:
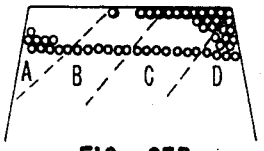

In FIG. 25B, the principle of this invention for separating numerically low turns from the numerically high turns in the critical radially-outside leg is illustrated. According to the present invention, rather than attempting to radially separate the conductors of the numerically low turns from the conductors of the numerically high turns, the conductors of the numerically low turns are separated laterally (axially) from the conductors of the numerically high turns. By using lateral separation of the turns of the radially-outside leg of the coil, rather than the more naturally occurring radial separation, the present invention advantageously makes use of the laterally-wide aspect of the radially-outside leg so that separation distances can be proportionally greater as the aspect ratio between the radial dimension and the lateral dimension increases. Consequently, in FIG. 25B each 25 percentile portion of the turns, with the lowest turn reference letter (A) being positioned to the left and the highest turn reference letter (D) being positioned to the right in the drawing, is illustrated by the dashed separation lines.

To accomplish the circumferential separation of the numerically low turns from the numerically high turns, one must overcome the natural tendency for the turns to seek the path of smallest radius, and particularly, to cause the turns to stack over a limited circumferential width of the available space for the radially-outside leg of the pie-shaped coil. This can be accomplished by control of the turn placement and winding tension (using the previously-described dynamic wire tensioner 68) with effective results, although positioning cannot be established with 100% accuracy and repeatability.

Figure 25C:
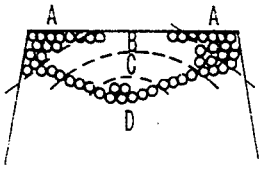

An additional alternative winding pattern, presently the preferred pattern, is shown in FIG. 25C and accomplished as follows. The first 25% of the turns (A) of a pie-shaped bundle are placed in the corners of the outside leg of the winding form, being generally equally distributed between the two corners. The second 25% of the turns (B) are then placed in a uniformed layer over the corner turns and the center portion of the outside leg of the winding form to provide a generally inwardly-bowed layer. The next 25% of the turns (C) are placed in a generally bowed layer in the central half of the outside leg of the winding form, i.e., in a layer ending prior to the laterally-outside walls of the outside leg. The last 25% of the turns (D) fills the central circumferential cavity left by the prior bowed layers of windings. With this configuration, the turns in the last 25% of the winding are separated from the turns in the first 25% of the winding, with which the greatest voltage differential exist, by the two inwardly-bowed layers (B and C) of winding. Moreover, if a turn in the forth 25% of the winding (D) is inadvertently displaced from the central circumferential cavity to overlie to a more lateral position, it will still be separated from the turns of the first 25% of the winding (A) by at least one of the intermediate bowed layers (B, C).

Figure 27:
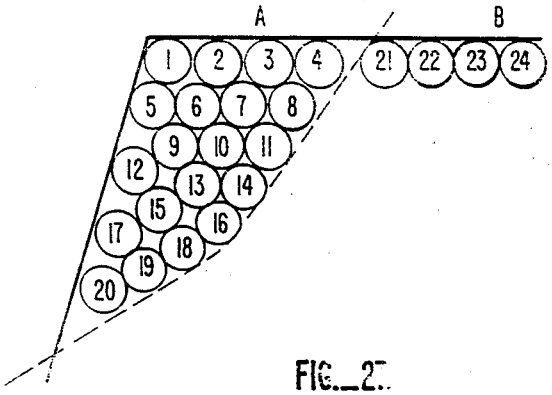
FIG. 27 is an enlarged view of a portion of FIG. 25B illustrating the placement of the turns of the winding.

With reference now to FIG. 27, an enlarged view of a portion of FIG. 25B which illustrates the position of the first several turns to be wound, the principle of this invention for providing separation of numerically low turns from numerically high turns will be appreciated. It should be noted that the turns are wound upon a core which is treated with a release lubricant. Therefore, a limited amount of friction is available to hold turns in their as wound position against forces applied thereafter as further turns are wound. This is particularly true when an earlier turn is placed so that it does not represent the shortest circumferential path and is unrestrained by other turns from moving in the direction of the shortest circumferential path. It will be noted that such a turn would have a tendency to move in the direction of the shortest circumferential path thereby causing loosening of the turns if it did indeed move in that direction.

The dynamic wire tensioning and control unit 68 as explained hereinafter in connection with FIG. 27 plays a role in the accurate placement of the turns of the wire 22 within the cavities of the winding forms 28. Particularly, the dynamic fashion with which the wire tension is controlled by controlling the torque applied to the tensioning wheel 78 through adjustments of the current applied to the magnetic clutch assembly 76 determines whether the wire 22 will be pulled to a lower turn radius within the cavity of the winding form 28 or will be allowed to remain at greater turn radius locations guided by the "v" gap between adjacent turns previously wound onto the winding form 28.

The control of wire tension to place turns within the winding cavity is used as follows. The first layer of turns, illustrated at turns 1, 2, 3 and 4 of FIG. 27, is wound with relatively high tension to maximize the limited friction available as a result of the release lubricant. Later turns 5–20 are wound in the indicated order. Note that the later wound turns do not lie on the smallest circumferential path, and thus, would have a tendency to move to the right in the FIG. 27 toward the smallest circumferential path for that turn. The subsequent layers of turns (5–8, 9–11, etc.), in contrast, are wound with relatively less winding force so that they may be guided by the "notch" formed by adjacent turns of the first layer, yet not so high so as to move the turns of the first layer toward the smallest circumferential path, i.e., to shift those turns to the right in FIG. 27.

Note that the turns of subsequent layers are positioned so that the rightward most turn seeks the last "notch" provided by the preceding row of turns. This causes the build of successive layers of turns to step toward the left by at least one-half a wire diameter for each layer such that the width of the build decreases as the layers accumulate in this embodiment.

In the preferred embodiment, the programmable controller 450 is used to vary the winding tension as the turns are wound from a minimum of about 10 lbs. to a maximum in excess of 45 lbs. tension. For the control convenience, three tension settings are used between 10 lbs. and 35 lbs. tension. In the particular preferred embodiment, the first layers (e.g. 1–4, 21–34) are the highest tension achieving the maximum friction as against the release lubricant while the second (5–8) and subsequent (9–11, 12–14, etc.) layers use the least tension setting for minimally shifting the turns of earlier layers. Thus, turn 20 is at the lowest tension while turn 21 is at the highest tension. Otherwise, turn 20 could slip and occupy the turn 21 position. As the winding progresses and the bottom layer of the radially-outside leg is filled, the tension is increased to the middle level to provide improved build uniformity.

Note that the main winding wheel 134 guides the wire 22 during winding onto the winding form 28 during forward rotations of the winding arm 26, i.e., in the direction of arrow of arrow 125 of FIG. 6. However, after winding the last turn onto the winding form 28, the rotation of the winding arm 26 reverses so as to rotate in the direction opposite the arrow 125 of FIG. 6 to lead the wire 22 around the outside of the exit pin 182. This reverse rotation positions the wire so that the winding form 28 may be indexed to the next position to the right while preventing the wire 22 wound on to the winding form 28 from partially unravelling during the indexing of the winding form 28.

During this reverse rotation of the winding arm 26, the small guide wheel 154 (shown in FIGS. 7 and 8) engages the wire 22 and limits the degree of lifting of the wire 22 from the winding pulley 134 so that it remains in a position to be received again by the groove within the winding pulley 134 during the winding of the next coil bundle. This reverse rotation of the winding arm 26 also positions the winding arm 26 and wire 22 so that it will not interfere with the indexing of the next winding form 28. The small guide wheel 154 also prevents the tension force applied to the winding arm 26 by the wire 22 from moving to a point beyond the castering axis of the guide wheel 134 (i.e., at the center of bore 164) which would cause the winding wheel 134 to pivot to an extreme position.

The machine control for the high voltage winding machine 10 is adapted to adjust the number of turns for respective coil bundles which will ultimately be assembled into a toroidal winding. By adjusting the number of turns in respective coil bundles, such that different coil bundles may have different number of turns, the total number of turns of a winding can be adjusted other than by an increment of 40 turns. For example, if each coil bundle had the same number of turns, an addition of one turn to each coil bundle in a winding having 40 bundles would result in a total addition of 40 turns. The 40 turn increment is too great for some applications. Thus, in one preferred embodiment of this invention, only a designated number of the bundles will receive an additional one or more turns.

With reference now to FIG. 19, a wire cutter 457 is illustrated which is mounted on a slide and controlled by an air cylinder. After the predetermined number of coil bundles have been wound, a control signal from the programmable controller causes the air cylinder to move the cutter 457 downwardly to place its cutting jaws 459 in engagement of the wire. A further movement of the cylinder causes the cutting jaws to close to sever the wire 22. Note that the number of bundles in a winding section can be greater than, less than or equal to the number of winding forms 28. Since the control to the cutter 457 determines the number of bundles in a winding section, that number is wholly independent of the number of winding forms 28.

Modification and variation can be made to the preferred embodiment without departing from the subject of the invention as defined in the following claims.

What is claimed is:

1. A machine for winding interconnected coil bundles comprising:

a plurality of separate winding forms, each such winding form having a winding cavity;

transfer means for independently moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles; and removing means for removing said wound coil bundles at said coil removal station with said coil bundles remaining interconnected and assembling said wound coil bundles in a relationship for functioning together as a continuous winding.

2. The machine of claim 1 wherein the winding form has a first plate and a second plate and a core therebetween defining the cavity.

3. The machine of claim 2 wherein the cavity is wedge-shaped suitable for use in a toroidal transformer.

4. The machine of claim 3 wherein the second plate has an edge with exit and entrance guide pins extending therefrom.

5. The machine of claim 4 wherein the wedgeshaped cavity has a wide radially-outward leg, a narrow radially-inward leg and tapering connecting legs.

6. The machine of claim 5 wherein the entrance guide pin is adjacent the radially-outward leg.

7. The machine of claim 6 wherein the entrance guide pin is positioned in a recess formed in the second plate, the recess and entrance guide pin defining a generally spiral path for the wire so to increase the radius of curvature of the wire at the entrance guide pin.

8. The machine of claim 5 wherein at least one of the first and second plates has a rounded edge between the entrance and exit guide pins and facing the cavity.

9. The machine of claim 2 wherein the winding form includes a fastener removably securing the first plate, the second plate and the core together.

10. The machine of claim 9 wherein the first plate and core form a unitary member to which the second plate is removably secured by the fastener.

11. The machine of claim 10 wherein the fastener includes a pin lock fastener and the winding form includes a complementary bore formed therein for receipt of the pin lock fastener.

12. The machine of claim 1 wherein each winding form includes an independently movable transfer pallet.

13. The machine of claim 12 wherein the winding form includes a mounting arm separating the transfer pallet from the winding cavity.

14. The machine of claim 13 wherein the winding cavity is oriented at an angle to the mounting arm to help reduce interference between the fly winding means and a previously wound winding form.

15. The machine of claim 1 wherein the fly winding means includes:

a winding arm, coupled to a source of wire, having an outer end and a wire winding guide assembly at the outer end; and means for rotating the winding arm about a coil winding axis, the winding arm configured so the wire winding guide assembly guides the wire into the cavity of a winding form at the winding station.

16. The machine of claim 15 wherein the fly winding means further comprises means for moving the winding arm along the coil winding axis according to the circumferential position the wire is to occupy within the cavity.

17. The machine of claim 16 wherein the winding arm rotating means includes a hollow drive spline having an interior bore defining a wire path portion through which the wire passes from the wire supply to the winding arm.

18. The machine of claim 17 wherein the drive spline includes first and second ends, the winding arm fixed, to the second end.

19. The machine of claim 1 further comprising a dynamic wire tensioner, engaging the wire along a tension path segment between a source of the wire and the fly winding means, for maintaining at least a desired tension on the wire between the tensioner and the fly winding means.

20. The machine of claim 19 wherein the desired tension is a variable tension.

21. The machine of claim 1 wherein the winding cavity has a predetermined shape.

22. The machine of claim 21 further comprising securing means for securing said coil bundles generally in said predetermined shape.

23. The machine of claim 22 wherein the securing means operates on the wound coil bundles before said coil bundles are removed at the coil removal station.

24. The machine of claim 23 wherein the securing means operates on the wound coil bundles after said coil bundles leave the winding station.

25. The machine of claim 22 wherein the transfer means moves each of said coil winding forms from said winding station, to a coil bundle securing station, at which said securing means secures said coil bundles, and to said coil removal station.

26. The machine of claim 22 wherein the securing means includes heating means for heating the coil bundles.

27. The machine of claim 26 wherein the heating means includes a heated surface configured to contact the winding form.

28. The machine of claim 27 wherein the heated surface includes a conformable, heat conducting surface layer to enhance surface contact between the heated surface and the winding form.

29. The machine of claim 26 wherein the heating means including a source of heat movable between a winding form heating position and a retracted position.

30. The machines of claim 29 wherein the source of heat includes heated surfaces and the heating means includes means for moving the heated surface into physical contact with the winding form with the source of heat at the heating position.

31. The machine of claim 1 wherein adjacent coil bundles are interconnected by an interconnection wire and further comprising means for cutting the interconnecting wire between selected ones of the coil bundles.

32. The machine of claim 31 wherein the cutting means is situated at the coil removal station.

33. The machine of claim 1 further comprising a coil bundle arbor at the coil removal station, the arbor having an outer end sized for receipt of the coil bundles.

34. The machine of claim 33 including a plurality of said arbors.

35. The machine of claim 34 including upper and lower arbor storage and transport tracks for the arbors at the coil removal station.

36. A machine for winding interconnected coil bundles comprising:

a plurality of winding forms, each such winding form having a winding cavity;

the winding form having a first plate and second plate and a core therebetween defining the cavity;

the second plate having an edge with exit and entrance guide pins extending therefrom;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles; and removing means for removing said wound coil bundles at said coil removal station with said coil bundles remaining interconnected and assembling said wound coil bundles in a relationship for functioning together as a continuous winding.

37. The machine of claim 36 further comprising means for adjusting the length of the wire interconnecting adjacent coil bundles.

38. The machine of claim 36 wherein the length adjusting means includes a portion of the edge adjacent at least one of the entrance and exit guide pins being spaced apart from the core according to the length of the wire desired to interconnect adjacent coil bundles.

39. A machine for winding interconnected coil bundles comprising:

a plurality of winding forms, each such winding form having a winding cavity;

the winding form having a first plate and a second plate and a core therebetween defining the cavity;

the winding form including a fastener removably securing the first plate, the second plate and the core together, the first plate and core forming a unitary member to which the second plate is removably secured by the fastener;

the fastener including a pin lock fastener and the winding form including a complementary bore formed therein for receipt of the pin lock fastener;

the pin lock fastener including a shaft, an inner end and an outer end, the outer end having a radially extending locking element and the inner end including an actuator coupled to the locking element which releases the locking element when operated so to permit the shaft to be at least partly withdrawn from the complementary bore;

transfer means for moving each of said coil winding forms from a winding section, to a coil removal station, and thereafter, to return said coil winding form to said winding station;

fly winding means for winding wire into said winding cavities of sequential ones of said winding forms at said winding station thereby forming said interconnected coil bundles; and removing means for removing said wound coil bundles at said coil removal station with said coil bundles remaining interconnected and assembling said wound coil bundles in a relationship for functioning together as a continuous winding.

40. The machine of claim 39 wherein the shaft includes a first gripping region at the inner end and the winding form includes a second gripping region.

41. A machine for winding interconnected coil bundles comprising:

a plurality of winding forms, each such winding form having a winding cavity and including a transfer pallet;

transfer means for moving each of said coil winding forms from a winding station, to a coil removal station, and thereafter, to return said coil winding form to said winding station;

the transfer means including spaced apart guide grooves and the transfer pallet including edges configured for slidable engagement within the guide grooves;

fly winding means for winding wire into said winding cavities of sequential ones of said winding forms at said winding station thereby forming said interconnected coil bundles; and removing means for removing said wound coil bundles at said coil removal station with said coil bundles remaining interconnected and assembling said wound coil bundles in a relationship for functioning together as a continuous winding.

42. A machine for winding interconnected coil bundles comprising:

a plurality of winding forms, each such winding form having a winding cavity and including a transfer pallet;

transfer means for moving each of said coil winding forms from a winding station, to a coil removal station, and thereafter, to return said coil winding form to said winding station;

the transfer means including a track configured for guidably supporting the transfer pallet for movement along the track;

fly minding means for winding wire into said winding cavities of sequential ones of said winding forms at said winding station whereby forming said interconnected coil bundles; and removing means for removing said wound coil bundles at said coil removal station with said coil bundles remaining interconnected and assembling said wound coil bundles in a relationship for functioning together as a continuous winding.

43. The machine of claim 42 wherein the transfer means includes a wait station between the coil removal station and the winding station at which winding form assemblies wait until needed at the winding station.

44. The machine of claim 43 wherein the track includes, in order, a generally horizontal first track between the winding station and the coil removal station, a generally vertical second track at the coil removal station, a generally horizontal third track between the coil removal station and the wait station, and a generally vertical fourth track between the wait station and the winding station.

45. The machine of claim 44 wherein the transfer means includes first, second, third and fourth drivers for engagably moving the transfer pallets along the first through fourth tracks.

46. The machine of claim 45 wherein the first driver is an indexing driver which incrementally moves at least some of the winding forms secured on the first track a chosen distance along the first track.

47. The machine of claim 46 wherein the indexing driver simultaneously indexes all winding forms situated along the first track.

48. The machine of claim 47 wherein any winding form at the winding station is simultaneously indexed by the indexing driver together with said winding forms situated along the first track between the winding station and the coil removal station.

49. The machine of claim 46 wherein the indexing driver includes:

a driver rod having transfer pallet engagement elements equally spaced along the drive rod;

a reciprocal axial driver which drives the drive rod between first and second axial positions; and a rotary driver which drives the drive rod between first and second rotary positions, the transfer pallet engagement elements engaged with the transfer pallets when the drive rod is in the first rotary position and disengaged from the transfer pallets when in the second rotary position.

50. The machine of claim 49 wherein the transfer pallet engagement elements each include a pair of radially extending finger elements.

51. The machine of claim 45 wherein the second track is a down track.

52. The machine of claim 51 wherein the third track is directly vertically beneath the first track.

53. The machine of claim 51 wherein the second driver includes a rodless cylinder extending along the second track.

54. The machine of claim 51 wherein the transfer means includes a movable support, movable between support and release orientations, for supporting a winding form at the intersection of the first and second tracks when the movable support is in a support orientation and for releasing said winding form to the second driver when the movable support is in a release orientation.

55. The machine of claim 54 wherein the movable support includes a pivotal support gate movable between support and release positions corresponding to the support and release orientations of the movable support.

56. The machine of claim 55 wherein the support gate includes an outer end, and wherein the movable support includes a locking pin selectably engagable with the outer end of the support gate when the support gate is in the support position.

57. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding; and the fly winding means including:

a winding arm, coupled to a source of wire, having an outer end and a wire winding guide assembly at the outer end;

means for rotating the winding arm about a coil winding axis, the winding arm configured so the wire winding guide assembly guides the wire into the cavity of a winding form at the winding station;

the winding arm rotating means including a hollow drive spline having an interior bore defining a wire path portion through which the wire passes from the wire supply to the winding arm, the drive spline including first and second ends, the winding arm fixed to the second end; and means for moving the winding arm along the coil winding axis according to the circumferential position the wire is to occupy within the cavity;

the winding arm axial moving means including:

a drive brace connected to the first end of the drive spline, the drive brace including a drive nut;

a drive screw engaging the drive nut:

means for rotating the drive screw within the drive nut so to drive the drive nut and drive brace therewith parallel to the coil winding axis and the drive spline along the coil winding axis.

58. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

the fly winding means including:

a winding arm, coupled to a source of wire, having an outer end and a wire winding guide assembly at the outer end: and means for rotating the winding arm about a coil winding axis, the winding arm configured so the wire winding guide assembly guides the wire into the cavity of a winding form at the winding station;

removing means for removing said wound coil bundles at said coil removal station with said coil bundles remaining interconnected and assembling said wound coil bundles in a relationship for functioning together as a continuous winding; and the winding form including a winding post and the fly winding means including a wire engaging device which traps the wire against the winding post at the start of the window of a winding form.

59. The machine of claim 58 wherein the winding form includes a cut-out portion from which the winding post extends, the cut-out portion and the winding post defining a generally spiral entry path for the wire to increase the bending radius of the wire at the winding post.

60. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding;

a dynamic wire tensioner, engaging the wire along a tension path segment between a source of the wire and the fly winding means, for maintaining at least a desired tension on the wire between the tensioner and the fly winding means; and the dynamic wire tensioner including a moving surface, along the tension path segment, frictionally engaging the wire and moving in a direction opposite the direction of movement of the wire.

61. The machine of claim 60 wherein the moving surface is circular.

62. The machine of claim 61 further comprising means, sensitive to the movement of the moving surface, for sensing a fault condition in the wire.

63. The machine of claim 62 wherein the fault condition includes a broken wire condition and an exhausted wire supply condition.

64. The machine of claim 61 wherein the tension path segment defines an arc of substantially less then 360½.

65. The machine of claim 61 wherein the tension path segment defines an arc of at least about 360°.

66. The machine of claim 60 wherein the dynamic wire tensioner includes means for biasing the wire against the moving surface.

67. The machine of claim 66 wherein the biasing means includes a belt movable along a bias path towards and away from the moving surface to vary the portion of the tension path segment the biasing means operates along.

68. The machine of claim 67 wherein the moving surface is circular.

69. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding;

a dynamic wire tensional, engaging the wire along a tension path segment between a source of the wire and the fly winding means, for maintaining at least a desired tension on the wire between the tensioner and the fly winding means; and the dynamic wire tensioner including:

a disc rotating in a first rotary direction and having an outer circumferential surface, the wire being wrapped around the circumferential surface at least once to define the tension path segment, the wire moving opposite the direction of movement of the circumferential surface; and means for biasing the wire against the circumferential surface so to maintain frictional engagement between the circumferential surface and the wire.

70. The machine of claim 69 wherein the tensioner includes means for controlling the operation of the rotating disc and the biasing means to apply a substantially constant torque on the tension path segment of the wire.

71. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding; and a tape dispenser between a wire source and the fly winding means for applying lengths of electrical insulating tape to selected points along the wire.

72. The machine of claim 71 wherein the tape dispenser includes a tape supply roll, a tape arbor, means for guiding the tape onto the tape arbor and means for cutting the tape on the tape arbor into tape segments.

73. The machine of claim 72 wherein the tape arbor includes means for retaining the tape segments thereon by vacuum.

74. The machine of claim 72 further comprising means for driving the arbor and the wire towards one another to transfer the length of tape to the wire.

75. The machine of claim 72 wherein the tape has a sticky side an the guiding means guides the tape onto the arbor with the sticky side facing out.

76. The machine of claim 72 wherein the arbor has a polygonal circumferential tape contacting surface.

77. A machine for winding interconnected coil bundles comprising:

a plurality of winding forms, each such winding form having a winding cavity with a predetermined shape;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining inteconnected and assembling said wound coil bundles in a relationship for functioning together as a continuous winding;

securing means for securing said coil bundles generally insaid predetermined shape;

the securing means including heating means for heating the coil bundles; and the securing means including means for cooling the coil bundles following the heating means.

78. A machine for winding interconnected coil bundles comprising:

a plurality of winding forms, each such winding form having a winding cavity with a predetermined shape;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding;

securing means for securing said coil bundles generally in said predetermining shape, the securing means includes heating means for heating the coil bundles;

the heating means including a source of heat movable between a winding form heating position and a retracted position;

the source of heat including a heated surface and the heating means including means for moving the heated surface into physical contact with the winding form with the source of heat at the heating position; and the heated surface including first and second heated surfaces positioned on opposite sides of the winding form.

79. The machine of claim 78 wherein the winding form includes a winding cavity defining portion, a transfer pallet engagable by the transfer means and a mounting arm separating the winding cavity defining portion from the transfer pallet.

80. The machine of claim 79 wherein the mounting arm includes means for reducing heat transfer along the mounting arm.

81. The machine of claim 80 wherein the heat transfer reducing means includes a reduced cross-sectional region along the mounting arm.

82. The machine of claim 81 wherein the reduced cross-sectional region includes a cut-out portion of the mounting arm and wherein the second heated surface includes a portion sized to pass through the cut-out portion of the winding arm.

83. A machine for winding interconnected coil bundles comprising:

a plurality of winding forms, each such winding form having a winding cavity with a predetermined shape;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding;

securing means for securing coil bundles generally in said predetermined shape, the securing means including heating means for heating the coil bundles;

the heating means including a source of heat movable between a winding form heating position and a retracted position;

the source of heat including a heated surface and the heating means including means for moving the heated surface into physical contact with the winding form with the source of heat at the heating position; and the source of heat including a radiant heat surface spaced apart from the winding form.

84. A machine for winding interconnected coil bundles comprising:

a plurality of winding forms, each such winding form having a winding cavity with a predetermined shape;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said coil bundles in a relationship for functioning together as a continuous winding;

securing means for securing said coil bundles generally in said predetermined shape, the securing means including heating means for heating the coil bundles; and the heating means including a plurality of heating station between the coil winding station and the coil removal station.

85. The machine of claim 84 wherein the heating means includes means for sensing the temperature of the winding form at each of the heating stations.

86. The machine of claim 84 wherein the heating means includes controlled means for heating the winding forms to at least two chosen temperatures at said plurality of heating stations.

87. The machine of claim 86 wherein said heating stations include at least initial and final heating stations.

88. The machine of claim 86 wherein the winding form chosen temperature for the initial heating station is greater than the winding form chosen temperature for the final heating station.

89. The machine of claim 88 wherein the temperature of the controlled heating means for the final heating station is about the winding form chosen temperature for the final heating station to help prevent overheating of the coil bundle.

90. The machine of claim 89 wherein the temperature of the controlled heating means for the initial heating station is substantially in excess of the winding form chosen temperature for the initial heating station to quickly heat the coil bundle at the initial heating station.

91. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal station with said coil bundles remaining interconnected and assembling said wound coil bundles in a relationship for functioning together as a continuous winding; and the coil removal station including a winding form disassembly station, a coil unloading station and a winding form reassembly station.

92. The machine of claim 91 wherein the winding form includes a pallet portion and a coil bundle portion separable from one another to expose the coil bundle on the coil bundle portion.

93. The machine of claim 92 wherein the removing means includes:

means for separating the coil bundle portion and coil bundle therewith from the pallet portion at the disassembly station;

means for transporting the coil bundle portion and coil bundle therewith to the coil unloading station;

means for unloading the coil bundle from the coil bundle portion at the coil unloading station;

means for transferring both the unloaded coil bundle portion and the pallet portion to the reassembly station; and means for reassembling the pallet portion and the coil bundle portion at the reassembly station.

94. The machine of claim 93 wherein the winding forms each include a fastener, manipulatable by the separating and reassembling means, which releasably secures the pallet and coil bundle portions together.

95. The machine of claim 94 wherein the connector element includes a pin lock fastener.

96. The machine of claim 95 wherein the coil bundle and pallet portions include aligned bores for receipt of the pin lock fastener, and wherein the pin lock fastener includes a shaft, an inner end and an outer end, the outer end having a radially extending locking element and the inner end including an actuator coupled to the locking element which releases the locking element when operated so to permit the shaft to be at least partly withdrawn from the aligned bores.

97. The machine of claim 96 wherein the shaft includes a first gripping region at the inner end and the winding form includes a second gripping region.

98. The machine of claim 96 wherein the separating means includes first and second means for engaging the first and second gripping regions using a first motion and means for axially separating the first and second engaging means using second motion so to disengage the pin lack fastener from the pallet portion.

99. The machine of claim 98 wherein the first motion is a pivotal motion and the second motion is a linear motion.

100. A machine for winding interconnected coil bundles comprising:

a plurality of winding forms, each such winding form having a winding cavity;

transfer means for moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles;

removing means for removing said wound coil bundles at said coil removal with said coil bundles remaining interconnected and assembling said wound coil bundles in a relationship for functioning together as a continuous winding;

a coil bundle arbor at the coil removal station, the arbor having an outer end sized for receipt of the coil bundles; and the outer end of the arbor including a coil bundle retention projection.

101. A machine for winding interconnected coil bundles comprising:

a plurality of winding forms, each such winding form having a winding cavity;

transfer means for moving each of said coil winding forms from a winding station, to a coil removal station, and therafter, to return said coil winding form to said winding station;

fly winding means for winding wire into said winding cavities of sequential ones of said winding forms at said winding station thereby forming said interconnected coil bundles;

removing means for removing said cound coil bundles at said coil removal station with said coil bundles remaining interconnected and assembling said wound coil bundles in a relationship for functioning together as a continuous winding of a transformer;

a coil bundle arbor at the coil removal station, the arbor having an outer end sized for receipt of the coil bundles; and the winding form including first and second portions separable to expose the coil bundle on the first portion.

102. The machine of claim 101 wherein the first portion of the winding form includes eject apertures aligned with the coil bundle thereon and the removing means includes eject pins operated to pass through the eject apertures so to drive the coil bundle onto the storage arbor.

103. The machine of claim 102 wherein at least one of the eject pins is a spring loaded eject pin.

104. A machine for winding interconnected coil bundles comprising:

a plurality of separate winding forms, each such winding form having a winding cavity;

transfer means for independently moving each of said coil from a winding station, to an intermediate station and a coil removal station, and thereafter, to return said coil winding form to said winding station;

fly winding means for winding wire into said winding cavities of sequential ones of said winding forms at said winding station thereby forming said interconnected coil bundles;

processing means at said intermediate station for performing a predetermined process on said wound coil bundle during the winding of a subsequent coil bundle by said fly winding means;

removing means for removing said wound coil bundles at said coil removal station with said coil bundles remaining interconnected for functioning together as a winding.

105. The machine of claim 104 wherein said processing means includes means for securing said wound coil bundle into a desired shape.

106. The machine of claim 105 wherein the desired shape is the shape of the winding cavity.

107. The machine of claim 106 wherein the winding cavity is pie-shaped.

108. A machine for winding interconnected coil bundles comprising:

a plurality of winding forms, each such winding form having a winding cavity;

transfer means for moving each of said coil winding forms form a winding station, to an intermediate station and a coil removal station, and thereafter, to return said coil winding form to said winding station;

fly winding means for winding wire into said winding cavities of sequential ones of said winding forms at said winding station thereby forming said interconnected coil bundles:

processing means at said intermediate station for performing a predetermined process on said wound coil bundle during the winding of a subsequent coil bundle by said fly winding means, said processing means including means for securing said wound coil bundle into a desired shape, the securing means including means for heating the coil bundle;

removing means for removing said wound coil bundles at said coil removal station with said coil bundles remaining interconnected for functioning together as a winding.

109. A machine for winding interconnected coil bundles having a pie-shape for assembly into a toroidal winding comprising:

a plurality of separate winding forms, each such winding form having a pie-shape for assembly into a toroidal winding;

transfer means for separately moving each of said coil winding forms from a winding station, to a coil removal station, and thereafter, to return said coil winding form to said winding station;

fly winding means for winding wire into said winding cavities of sequential ones of said winding forms at said winding station thereby forming said interconnected coil bundles having said pie-shape; and removing means for removing said wound coil bundles at said coil removal station with said coils remaining interconnected for forming at least a portion of a toroidal winding of a transformer.

110. The machine of claim 109 further comprising means for securing the coil bundles on the winding forms into said pie-shape prior to the coil removal station.

111. A machine for winding interconnected coil bundles comprising:

a plurality of separate winding forms, each such winding form having a winding cavity;

transfer means for independently moving each of said coil winding forms from a winding station, to an intermediate station and a coil removal station, and thereafter, to return said coil winding form to said winding station;

fly winding means for winding wire into said winding cavities of sequential ones of said winding forms at said winding station thereby forming said interconnected coil bundles;

processing means at said intermediate station for performing a predetermined process on said wound coil bundle;

removing means for removing said wound coil bundles at said coil removal station with said coil bundles remaining interconnected for functioning together as a winding of a transformer;

control means for controlling said coil winding machine for initiating the transfer of coil winding forms between said stations, said control means responding to the last to be completed of said windings by said fly winding means, said performing a predetermined process by said processing means, and said coil removing by said removing means to transfer said winding forms upon said last to be completed of said winding, performing and removing.

* * * * *